US008419150B2

(12) United States Patent
Bansyo

(10) Patent No.: US 8,419,150 B2
(45) Date of Patent: Apr. 16, 2013

(54) INKJET PRINTER EMPLOYING INK CIRCULATION SYSTEM

(75) Inventor: Toshihiro Bansyo, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 294 days.

(21) Appl. No.: 12/968,370

(22) Filed: Dec. 15, 2010

(65) Prior Publication Data

US 2011/0242155 A1 Oct. 6, 2011

(30) Foreign Application Priority Data

Mar. 30, 2010 (JP) ..... P2010-077470

(51) Int. Cl.
*B41J 29/38* (2006.01)

(52) U.S. Cl.
USPC ..... 347/14; 347/6; 347/17

(58) Field of Classification Search ..... 347/5, 6, 347/9, 14, 17
See application file for complete search history.

(56) References Cited

U.S. PATENT DOCUMENTS

| | | | | |
|---|---|---|---|---|
| 5,291,215 | A * | 3/1994 | Nozawa et al. | 347/18 |
| 8,256,860 | B2 * | 9/2012 | Nakamura | 347/14 |
| 2009/0195588 | A1 * | 8/2009 | Ogama | 347/17 |

FOREIGN PATENT DOCUMENTS

| | | | |
|---|---|---|---|
| JP | 2006-088575 | A | 4/2004 |
| JP | 2009-255327 | A | 11/2009 |

* cited by examiner

*Primary Examiner* — Lam S Nguyen
(74) *Attorney, Agent, or Firm* — Jerald L. Meyer; Nath, Goldberg & Meyer

(57) ABSTRACT

An inkjet printer employing an ink circulation system includes an ink temperature adjusting unit configured to adjust temperatures of circulating ink. The ink temperature adjusting unit includes: a first temperature-adjusting path for cooling ink connected to a first ink circulation path and a second ink circulation path; and a second temperature-adjusting path for heating ink connected to the second ink circulation path separately from the first temperature-adjusting path, connected to the first ink circulation path while joining the first temperature-adjusting path, and having a larger flow path resistance than that of the first temperature-adjusting path at least on a side near the first ink circulation path.

9 Claims, 20 Drawing Sheets

FIG. 7

| TEMPERATURE OF INK [°C] | 5°C | 10°C | 15°C | 20°C | 25°C | 30°C | 35°C | 40°C | 45°C |
|---|---|---|---|---|---|---|---|---|---|
| VISCOSITY OF INK [mPa·s] | 22.3 | 18.0 | 14.6 | 12.0 | 10.0 | 8.6 | 7.4 | 6.5 | 5.6 |

FIG. 8A

HEATING →

| | DIAMETER mm ϕ | LENGTH mm L | FLOW PATH RESISTANCE R[Pa*s/m^3] 5℃ | 10℃ | 15℃ | 20℃ | 25℃ |
|---|---|---|---|---|---|---|---|
| SINGLE HOLE OF HEAT EXCHANGER A ϕA·L | 4 | 300 | 1.064E-03 | 8.599E-04 | 6.989E-04 | 5.744E-04 | 4.797E-04 |
| HEAT EXCHANGER A FOR SINGLE COLOR (6 HOLES) | ϕ4×6 HOLES | 300 | 1.774E-04 | 1.433E-04 | 1.165E-04 | 9.573E-05 | 7.995E-05 |
| SINGLE HOLE OF HEAT EXCHANGER B ON INLET SIDE ϕB1·L1 | 4 | 190 | 6.740E-04 | 5.446E-04 | 4.426E-04 | 3.638E-04 | 3.038E-04 |
| HEAT EXCHANGER B FOR SINGLE COLOR ON INLET SIDE (6 HOLES) | ϕ4×6 HOLES | 190 | 1.123E-04 | 9.077E-05 | 7.377E-05 | 6.063E-05 | 5.064E-05 |
| SINGLE HOLE OF HEAT EXCHANGER B ON OUTLET SIDE ϕB2·L2 | 3.9 | 110 | 4.318E-04 | 3.489E-04 | 2.836E-04 | 2.330E-04 | 1.946E-04 |
| HEAT EXCHANGER B FOR SINGLE COLOR ON OUTLET SIDE (6 HOLES) | ϕ3.9×6 HOLES | 110 | 7.196E-05 | 5.815E-05 | 4.726E-05 | 3.884E-05 | 3.244E-05 |
| | FLOW PATH RESISTANCE A+B | 0℃ | 9.038E-05 | 7.303E-05 | 5.936E-05 | 4.878E-05 | 4.074E-05 |
| | | 5℃ | 8.693E-05 | 7.031E-05 | 5.726E-05 | 4.719E-05 | 3.954E-05 |
| | | 10℃ | 8.400E-05 | 6.806E-05 | 5.556E-05 | 4.591E-05 | 3.857E-05 |
| | | 15℃ | 8.161E-05 | 6.625E-05 | 5.420E-05 | 4.489E-05 | 3.774E-05 |
| | | 20℃ | 7.971E-05 | 6.483E-05 | 5.312E-05 | 4.402E-05 | 3.694E-05 |
| HEAT EXCHANGER A | FLOW RATE Q [mL/s] | 0℃ | 1.529 | 1.529 | 1.529 | 1.529 | 1.529 |
| | | 5℃ | 1.470 | 1.472 | 1.475 | 1.479 | 1.484 |
| | | 10℃ | 1.421 | 1.425 | 1.431 | 1.439 | 1.447 |
| | | 15℃ | 1.380 | 1.387 | 1.396 | 1.407 | 1.416 |
| | | 20℃ | 1.348 | 1.357 | 1.368 | 1.379 | 1.386 |
| HEAT EXCHANGER B | FLOW RATE Q [mL/s] | 0℃ | 1.471 | 1.471 | 1.471 | 1.471 | 1.471 |
| | | 5℃ | 1.530 | 1.528 | 1.525 | 1.521 | 1.516 |
| | | 10℃ | 1.579 | 1.575 | 1.569 | 1.561 | 1.553 |
| | | 15℃ | 1.620 | 1.613 | 1.604 | 1.593 | 1.584 |
| | | 20℃ | 1.652 | 1.643 | 1.632 | 1.621 | 1.614 |
| RATIO OF FLOW RATE OF HEAT EXCHANGER B TO FLOW RATE OF HEAT EXCHANGER A SET TO 1 (B/A) | RATIO OF FLOW RATE (TIMES) | 0℃ | 0.96 | 0.96 | 0.96 | 0.96 | 0.96 |
| | | 5℃ | 1.04 | 1.04 | 1.03 | 1.03 | 1.02 |
| | | 10℃ | 1.11 | 1.11 | 1.10 | 1.08 | 1.07 |
| | | 15℃ | 1.17 | 1.16 | 1.15 | 1.13 | 1.12 |
| | | 20℃ | 1.23 | 1.21 | 1.19 | 1.17 | 1.16 |

TEMPERATURE OF ENTERING INK↑

↑ DIFFERENCE IN TEMPERATURE BETWEEN INK COMING OUT FROM A AND INK COMING OUT FROM B

FIG. 8B

COOLING

| | | | FLOW PATH RESISTANCE R [Pa*s/m^3] | | | |
|---|---|---|---|---|---|---|
| | DIAMETER mm ϕ | LENGTH mm L | 30℃ | 35℃ | 40℃ | 45℃ |
| SINGLE HOLE OF HEAT EXCHANGER A ϕA·L | 4 | 300 | 4.083E-04 | 3.534E-04 | 3.084E-04 | 2.667E-04 |
| HEAT EXCHANGER A FOR SINGLE COLOR (6 HOLES) | ϕ4×6 HOLES | 300 | 6.804E-05 | 5.890E-05 | 5.140E-05 | 4.446E-05 |
| SINGLE HOLE OF HEAT EXCHANGER B ON INLET SIDE ϕB1·L1 | 4 | 190 | 2.586E-04 | 2.238E-04 | 1.953E-04 | 1.689E-04 |
| HEAT EXCHANGER B FOR SINGLE COLOR ON INLET SIDE (6 HOLES) | ϕ4×6 HOLES | 190 | 4.309E-05 | 3.730E-05 | 3.256E-05 | 2.816E-05 |
| SINGLE HOLE OF HEAT EXCHANGER B ON OUTLET SIDE ϕB2·L2 | 3.9 | 110 | 1.657E-04 | 1.434E-04 | 1.251E-04 | 1.082E-04 |
| HEAT EXCHANGER B FOR SINGLE COLOR ON OUTLET SIDE (6 HOLES) | ϕ3.9×6 HOLES | 110 | 2.761E-05 | 2.390E-05 | 2.086E-05 | 1.804E-05 |
| | FLOW PATH RESISTANCE A+B | 0℃ | 3.467E-05 | 3.001E-05 | 2.619E-05 | 2.265E-05 |
| | | 5℃ | 3.616E-05 | 3.116E-05 | 2.713E-05 | 2.352E-05 |
| | | 10℃ | 3.794E-05 | 3.253E-05 | 2.820E-05 | 2.439E-05 |
| | | 15℃ | 4.003E-05 | 3.416E-05 | 2.946E-05 | 2.536E-05 |
| | | 20℃ | 4.236E-05 | 3.604E-05 | 3.095E-05 | 2.651E-05 |
| HEAT EXCHANGER A | FLOW RATE Q [mL/s] | 0℃ | 1.529 | 1.529 | 1.529 | 1.529 |
| | | 5℃ | 1.466 | 1.473 | 1.476 | 1.472 |
| | | 10℃ | 1.390 | 1.406 | 1.416 | 1.416 |
| | | 15℃ | 1.302 | 1.326 | 1.346 | 1.353 |
| | | 20℃ | 1.203 | 1.233 | 1.262 | 1.278 |
| HEAT EXCHANGER B | FLOW RATE Q [mL/s] | 0℃ | 1.471 | 1.471 | 1.471 | 1.471 |
| | | 5℃ | 1.534 | 1.527 | 1.524 | 1.528 |
| | | 10℃ | 1.610 | 1.594 | 1.584 | 1.584 |
| | | 15℃ | 1.698 | 1.674 | 1.654 | 1.647 |
| | | 20℃ | 1.797 | 1.767 | 1.738 | 1.722 |
| RATIO OF FLOW RATE OF HEAT EXCHANGER B TO FLOW RATE OF HEAT EXCHANGER A SET TO 1 (B/A) | RATIO OF FLOW RATE (TIMES) | 0℃ | 0.96 | 0.96 | 0.96 | 0.96 |
| | | 5℃ | 1.05 | 1.04 | 1.03 | 1.04 |
| | | 10℃ | 1.16 | 1.13 | 1.12 | 1.12 |
| | | 15℃ | 1.30 | 1.26 | 1.23 | 1.22 |
| | | 20℃ | 1.49 | 1.43 | 1.38 | 1.35 |

← TEMPERATURE OF ENTERING INK

↑ DIFFERENCE IN TEMPERATURE BETWEEN INK COMING OUT FROM A AND INK COMING OUT FROM B

FIG. 9A

HEATING

| | | | FLOW PATH RESISTANCE R[Pa*s/m^3] | | | | |
|---|---|---|---|---|---|---|---|
| | DIAMETER mm φ | LENGTH mm L | 5℃ | 10℃ | 15℃ | 20℃ | 25℃ |
| SINGLE HOLE OF HEAT EXCHANGER A φA·L | 3 | 300 | 3.363E-03 | 2.718E-03 | 2.209E-03 | 1.815E-03 | 1.516E-03 |
| HEAT EXCHANGER A FOR SINGLE COLOR (6 HOLES) | φ3*6 HOLES | 300 | 5.605E-04 | 4.530E-04 | 3.681E-04 | 3.025E-04 | 2.527E-04 |
| SINGLE HOLE OF HEAT EXCHANGER B ON INLET SIDE φB1·L1 | 4 | 190 | 6.740E-04 | 5.446E-04 | 4.426E-04 | 3.638E-04 | 3.038E-04 |
| HEAT EXCHANGER B FOR SINGLE COLOR ON INLET SIDE (6 HOLES) | φ4*6 HOLES | 190 | 1.123E-04 | 9.077E-05 | 7.377E-05 | 6.063E-05 | 5.064E-05 |
| SINGLE HOLE OF HEAT EXCHANGER B ON OUTLET SIDE φB2·L2 | 2.4 | 110 | 3.011E-03 | 2.433E-03 | 1.977E-03 | 1.625E-03 | 1.357E-03 |
| HEAT EXCHANGER B FOR SINGLE COLOR ON OUTLET SIDE (6 HOLES) | φ2.4*6 HOLES | 110 | 5.018E-04 | 4.055E-04 | 3.296E-04 | 2.708E-04 | 2.262E-04 |
| | FLOW PATH RESISTANCE A+B | 0℃ | 2.931E-04 | 2.368E-04 | 1.925E-04 | 1.582E-04 | 1.321E-04 |
| | | 5℃ | 2.692E-04 | 2.180E-04 | 1.780E-04 | 1.472E-04 | 4.218E-05 |
| | | 10℃ | 2.471E-04 | 2.011E-04 | 1.653E-04 | 5.051E-05 | 1.168E-04 |
| | | 15℃ | 2.276E-04 | 1.865E-04 | 6.146E-05 | 1.298E-04 | 1.104E-04 |
| | | 20℃ | 2.111E-04 | 7.562E-05 | 1.454E-04 | 1.226E-04 | 1.039E-04 |
| HEAT EXCHANGER A | FLOW RATE Q[mL/s] | 0℃ | 1.568 | 1.568 | 1.568 | 1.568 | 1.568 |
| | | 5℃ | 1.441 | 1.444 | 1.450 | 1.460 | 0.501 |
| | | 10℃ | 1.322 | 1.332 | 1.347 | 0.501 | 1.387 |
| | | 15℃ | 1.218 | 1.235 | 0.501 | 1.287 | 1.311 |
| | | 20℃ | 1.130 | 0.501 | 1.185 | 1.215 | 1.233 |
| HEAT EXCHANGER B | FLOW RATE Q[mL/s] | 0℃ | 1.432 | 1.432 | 1.432 | 1.432 | 1.432 |
| | | 5℃ | 1.559 | 1.556 | 1.550 | 1.540 | 2.499 |
| | | 10℃ | 1.678 | 1.668 | 1.653 | 2.499 | 1.613 |
| | | 15℃ | 1.782 | 1.765 | 2.499 | 1.713 | 1.689 |
| | | 20℃ | 1.870 | 2.499 | 1.815 | 1.785 | 1.767 |
| RATIO OF FLOW RATE OF HEAT EXCHANGER B TO FLOW RATE OF HEAT EXCHANGER A SET TO 1 (B/A) | RATIO OF FLOW RATE (TIMES) | 0℃ | 0.91 | 0.91 | 0.91 | 0.91 | 0.91 |
| | | 5℃ | 1.08 | 1.08 | 1.07 | 1.05 | 4.99 |
| | | 10℃ | 1.27 | 1.25 | 1.23 | 4.99 | 1.16 |
| | | 15℃ | 1.46 | 1.43 | 4.99 | 1.33 | 1.29 |
| | | 20℃ | 1.66 | 4.99 | 1.53 | 1.47 | 1.43 |

TEMPERATURE OF ENTERING INK↑

↑ DIFFERENCE IN TEMPERATURE BETWEEN INK COMING OUT FROM A AND INK COMING OUT FROM B

FIG. 9B

COOLING →

| | | | FLOW PATH RESISTANCE R[Pa*s/m^3] | | | |
|---|---|---|---|---|---|---|
| | DIAMETER mm ϕ | LENGTH mm L | 30℃ | 35℃ | 40℃ | 45℃ |
| SINGLE HOLE OF HEAT EXCHANGER A ϕA·L | 3 | 300 | 1.290E-03 | 1.117E-03 | 9.748E-04 | 8.430E-04 |
| HEAT EXCHANGER A FOR SINGLE COLOR (6 HOLES) | ϕ3×6 HOLES | 300 | 2.151E-04 | 1.861E-04 | 1.625E-04 | 1.405E-04 |
| SINGLE HOLE OF HEAT EXCHANGER B ON INLET SIDE ϕB1·L1 | 4 | 190 | 2.586E-04 | 2.238E-04 | 1.953E-04 | 1.689E-04 |
| HEAT EXCHANGER B FOR SINGLE COLOR ON INLET SIDE (6 HOLES) | ϕ4×6 HOLES | 190 | 4.309E-05 | 3.730E-05 | 3.256E-05 | 2.816E-05 |
| SINGLE HOLE OF HEAT EXCHANGER B ON OUTLET SIDE ϕB2·L2 | 2.4 | 110 | 1.155E-03 | 9.998E-04 | 8.726E-04 | 7.547E-04 |
| HEAT EXCHANGER B FOR SINGLE COLOR ON OUTLET SIDE (6 HOLES) | ϕ2.4×6 HOLES | 110 | 1.925E-04 | 1.666E-04 | 1.454E-04 | 1.258E-04 |
| | FLOW PATH RESISTANCE A+B | 0℃ | 1.124E-04 | 9.732E-05 | 8.494E-05 | 7.346E-05 |
| | | 5℃ | 1.174E-04 | 1.011E-04 | 8.806E-05 | 7.635E-05 |
| | | 10℃ | 1.233E-04 | 1.057E-04 | 9.161E-05 | 7.924E-05 |
| | | 15℃ | 1.303E-04 | 1.112E-04 | 9.582E-05 | 8.250E-05 |
| | | 20℃ | 1.382E-04 | 1.175E-04 | 1.008E-04 | 8.633E-05 |
| HEAT EXCHANGER A | FLOW RATE Q [mL/s] | 0℃ | 1.568 | 1.568 | 1.568 | 1.568 |
| | | 5℃ | 1.506 | 1.512 | 1.516 | 1.512 |
| | | 10℃ | 1.430 | 1.445 | 1.456 | 1.456 |
| | | 15℃ | 1.341 | 1.365 | 1.385 | 1.392 |
| | | 20℃ | 1.241 | 1.272 | 1.301 | 1.317 |
| HEAT EXCHANGER B | FLOW RATE Q [mL/s] | 0℃ | 1.432 | 1.432 | 1.432 | 1.432 |
| | | 5℃ | 1.494 | 1.488 | 1.484 | 1.488 |
| | | 10℃ | 1.570 | 1.555 | 1.544 | 1.544 |
| | | 15℃ | 1.659 | 1.635 | 1.615 | 1.608 |
| | | 20℃ | 1.759 | 1.728 | 1.699 | 1.683 |
| RATIO OF FLOW RATE OF HEAT EXCHANGER B TO FLOW RATE OF HEAT EXCHANGER A SET TO 1 (B/A) | RATIO OF FLOW RATE (TIMES) | 0℃ | 0.91 | 0.91 | 0.91 | 0.91 |
| | | 5℃ | 0.99 | 0.98 | 0.98 | 0.98 |
| | | 10℃ | 1.10 | 1.08 | 1.06 | 1.06 |
| | | 15℃ | 1.24 | 1.20 | 1.17 | 1.15 |
| | | 20℃ | 1.42 | 1.36 | 1.31 | 1.28 |

← TEMPERATURE OF ENTERING INK

↑ DIFFERENCE IN TEMPERATURE BETWEEN INK COMING OUT FROM A AND INK COMING OUT FROM B

INKJET PRINTER EMPLOYING INK CIRCULATION SYSTEM

CROSS REFERENCE TO RELATED APPLICATION

This application is based upon and claims the benefit of priority from the prior Japanese Patent Application No. 2010-077470, filed on Mar. 30, 2010, the entire contents of which are incorporated herein by reference.

BACKGROUND OF THE INVENTION

1. Field of the Invention

The present invention relates to an inkjet printer, and specifically relates to an inkjet printer which employs an ink circulation system and has a function of adjusting the temperature of ink circulating therein.

2. Description of the Related Art

Low-cost inkjet printers which are capable of high-speed color printing are widely used. An inkjet printer is connected to a terminal, such as a personal computer, and then takes in data of image, such as letters, illustrations and symbols, produced by the terminal, and prints the image on a sheet. With a multifunctional inkjet printer integrated with a scanner and a facsimile, image data taken in from the scanner unit or image data transferred through the facsimile can be printed.

In an inkjet printer, a temperature range which guarantees the performance of ink used for printing is specified in order to obtain a good print result. Japanese Unexamined Patent Application Publication No. 2006-88575 discloses an inkjet printer employing an ink circulation system which is configured to circulate ink therein, and is effective in guaranteeing the performance of the ink as described above. This inkjet printer includes a heater which is configured to heat the ink, and a cooler which is configured to cool the ink. When the temperature of the ink is too low to be in the temperature range which guarantees the performance of the ink, the ink is heated by using the heater. When the temperature of the ink is too high to be in the temperature range which guarantees the performance of the ink, the ink is cooled by using the cooler. The heater and the cooler are provided along an ink circulation path with the ink circulation path in between so as to make an ink circulation unit thereof smaller.

In an inkjet printer employing this type of ink circulation system, however, even if the ink flowing in the ink circulation path is heated by using the heater, the cooler which is provided side by side with the heater ends up drawing the heat from the ink. Accordingly, with poor heating efficiency as a result, it is necessary to increase heat energy from the heater in order to guarantee the performance of the ink. This leads to an increase in power consumption of the inkjet printer.

Japanese Unexamined Patent Application Publication No. 2009-255327 discloses a printing device which solves such a technical problem. This printing device includes in an ink circulation path thereof: a heater-side path which goes through a heater; a cooler-side path which goes through a cooler; a solenoid valve which is configured to switch back and forth between the heater-side path and the cooler-side path; and a controller which is configured to control the solenoid valve by software processing. The solenoid valve is driven by control coming from the controller, so that the flow of ink into the heater-side path and the flow of ink into the cooler-side path can be switched back and forth therebetween. In other words, in this printing device, it is possible to efficiently heat the ink flowing in the heater-side path by using the heater, or efficiently cool the ink flowing in the cooler-side path by using the cooler by switching the path by the solenoid valve.

SUMMARY OF THE INVENTION

However, in the printing device disclosed in Japanese Patent Application Publication No. 2009-255327, the following points are not taken into consideration. Specifically, it is necessary to install a solenoid valve which is configured to switch back and forth between the heater-side path and the cooler-side path in the ink circulation path and a control system including software which is configured to control the solenoid valve, resulting in an increase in the number of parts therefor. Further, the increase in the number of the parts makes the mechanical structure and control system of the printing device complex. As a result, the production cost and product cost of the printing device are increased.

An object of the present invention is to provide an inkjet printer employing an ink circulation system in which heating efficiency of ink circulating in an ink circulating path while maintaining cooling efficiency thereof can be increased with a simple configuration.

An aspect of the present invention is an inkjet printer comprising: an inkjet print head; a first ink circulation path connected to the print head and configured to supply ink to the print head; a second ink circulation path connected to the print head and configured to circulate ink discharged from the print head; and an ink temperature adjusting unit, wherein the ink temperature adjusting unit includes a first temperature-adjusting path connected to the first ink circulation path and the second ink circulation path for use in cooling ink discharged from the print head, and a second temperature-adjusting path connected to the second ink circulation path separately from the first temperature-adjusting path and connected to the first ink circulation path while joining the first temperature-adjusting path for use in heating ink discharged from the print head, the second temperature-adjusting path having a larger flow path resistance than a flow path resistance of the first temperature-adjusting path at least on a side thereof near the first ink circulation path.

BRIEF DESCRIPTION OF THE DRAWINGS

FIG. 4A is a top view of a main portion of the ink temperature adjusting unit shown in FIG. 3, whereas

FIG. 6A is a perspective view of a model (ink temperature adjusting unit) which is used for calculation of the flow rate of ink circulating in the ink temperature adjusting unit according to the first embodiment, whereas

FIG. 7 is a view showing the relationship between the temperature of ink and the viscosity of the ink in the ink temperature adjusting unit according to the first embodiment.

FIGS. 8A and 8B are a diagram showing first calculation results which describe the relationship between a flow path resistance and a flow rate in the ink temperature adjusting unit according to the first embodiment.

FIGS. 9A and 9B are a diagram showing second calculation results which describe the relationship between a flow path resistance and a flow rate in the ink temperature adjusting unit according to the first embodiment.

FIG. 10A is a top view which describes a first modification example of the ink temperature adjusting unit in the inkjet printer according to the first embodiment, whereas

FIG. 11A is a top view which describes a second modification example of the ink temperature adjusting unit in the inkjet printer according to the first embodiment, whereas

FIG. 12A is a top view which describes a third modification example of the ink temperature adjusting unit in the inkjet printer according to the first embodiment, whereas

FIG. 13A is a top view which describes a fourth modification example of the ink temperature adjusting unit in the inkjet printer according to the first embodiment, whereas

FIG. 14A is a top view which describes a third modification example of the ink temperature adjusting unit in the inkjet printer according to the fifth embodiment, whereas

FIG. 15A is a top view which describes a sixth modification example of the ink temperature adjusting unit in the inkjet printer according to the first embodiment, whereas

FIG. 16A is a top view which describes a seventh modification example of the ink temperature adjusting unit in the inkjet printer according to the first embodiment, whereas

FIG. 17A is a top view which describes an eighth modification example of the ink temperature adjusting unit in the inkjet printer according to the first embodiment, whereas

FIG. 18A is a top view which describes a ninth modification example of the ink temperature adjusting unit in the inkjet printer according to the first embodiment, whereas

DETAILED DESCRIPTION OF THE EMBODIMENT

Hereinafter, embodiments of the present invention will be described by referring to drawings. It should be noted that same or equivalent portions and components among the drawings are denoted by same or equivalent reference letters, and description thereof will be omitted or simplified. It should also be noted that the drawings are schematic, and therefore differ from actual ones.

Embodiments described hereinafter are examples of a device and a method which are used for giving a concrete form to a technical idea of the present invention, and the technical idea of the present invention does not specify arrangement and the like of respective constituent portions to those described hereinafter. The technical idea of the present invention can be variously modified within the scope of the claims of the present invention.

First Embodiment

The first embodiment of the present invention describes an example of applying the present invention to a color inkjet printer which employs an ink circulation system. It should be noted that, in the first embodiment and examples described thereafter, an ink circulation system for an ink of a single color, for example, a black ink, will be described for easy understanding, and the configuration thereof or a similar configuration, although whose description will be omitted, is adopted for ink circulation systems of other respective colors, specifically, a cyan ink, a magenta ink and a yellow ink. In other words, four ink circulation systems which independently circulate the respective four colors are installed in the color inkjet printer. In addition, the present invention is not necessarily applied only to color inkjet printers, but can be applied to monochrome jet printers including grey scale printers.

Apparatus Configuration of Inkjet Printer

Figure 2:
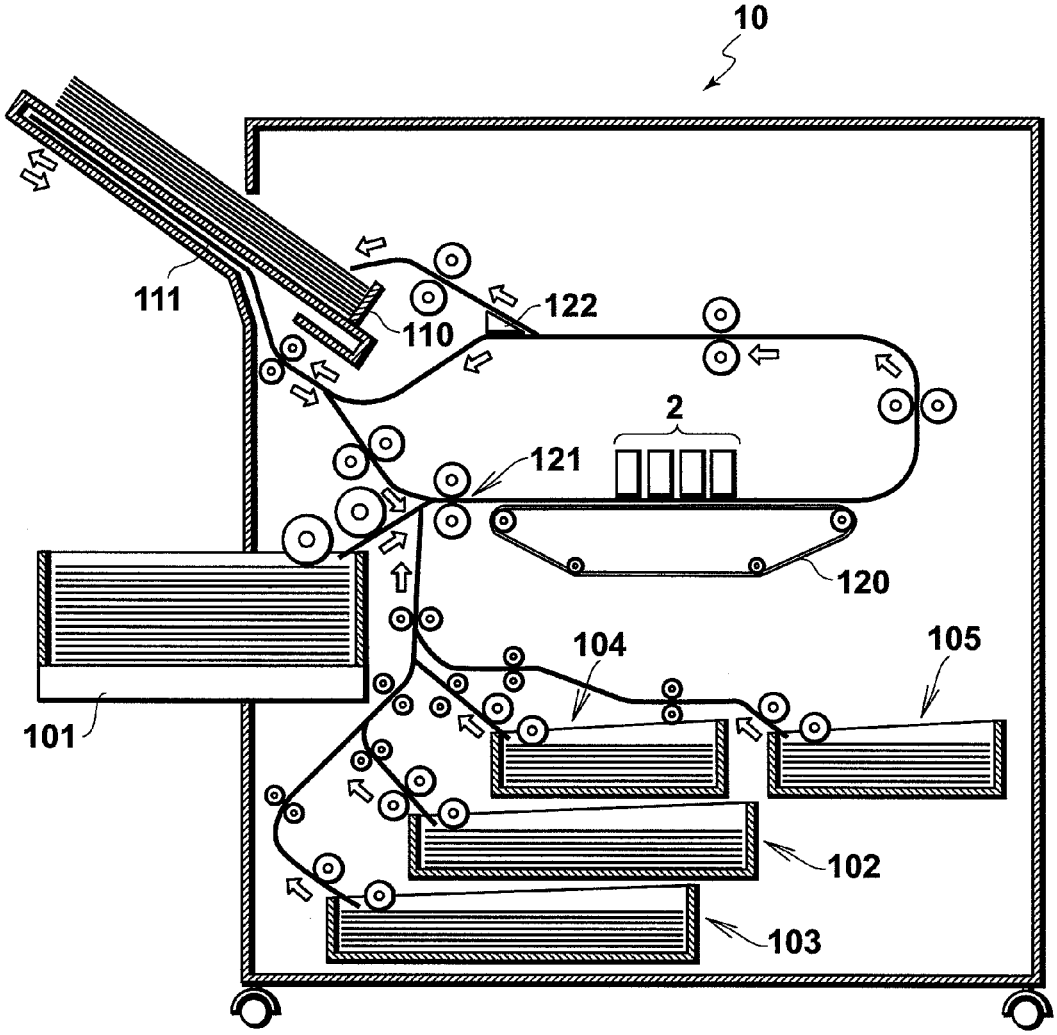
FIG. 2 is a schematic diagram illustrating a print unit of the inkjet printer according to the first embodiment.

As shown in FIG. 2, an inkjet printer 10 which employs an ink circulation system according to the first embodiment includes a sheet transfer unit which is configured to supply a sheet for printing, perform printing on the sheet, and discharge the printed sheet. In the inkjet printer 10, a detachably-attachable paper feed table 101 is arranged on a left side surface of a case, which is denoted by no reference numeral, in such a manner as to project outwardly from the case, and multiple paper feed trays 102, 103, 104 and 105 are arranged inside the case. In these paper feed table 101 and the paper feed trays 102 to 105, unprinted sheets (before printing) are stored. Further, on a left-side upper portion of the case of the inkjet printer 10, a paper receiving table 110 is arranged. The paper receiving tray 110 is configured to receive a printed sheet (after printing).

The inkjet printer 10 includes multiple print heads 2 which each has many nozzles arranged in an orthogonal direction to a transfer direction of a sheet fed from the paper feeding table 101 or the like. The print heads 2 are configured to respectively discharge a black ink, a cyan ink, a magenta ink and a yellow ink, and thereby perform printing line by line. The inkjet printer 10 according to the first embodiment is a color inkjet printer which employs an inkjet system. It should be noted that the inkjet printer 10 according to the first embodiment is not limited to a system in which printing is performed line by line, and may be applied to a serial system in which printing is performed by scanning in a line direction.

Printing Operation of Inkjet Printer

Printing operation of the inkjet printer 10 shown in FIG. 2 described above is as follows. First of all, an unprinted sheet, which is not specifically denoted, fed from any one of the paper feeding table 101 and the paper feeding trays 102 to 105 is transferred along a paper feeding-system transfer path inside the case by a driving unit (not given a reference numeral in particular) formed with a roller and the like, and guided to a resister 121. The resister 121 has functions of positioning a front end of a transferred sheet in a feeding direction, skew correction, and the like, and has a pair of resist rollers arranged in a perpendicular direction to the paper feeding-system transfer path. A sheet transferred by the resister 121 is once stopped here, and then transferred at a predetermined timing toward a print unit (printer), in which the print heads 2 are arranged.

In a region facing the print heads 2 with the paper feeding-system transfer path in between, a circular transfer belt 120 is arranged. The transfer belt 120 is configured to transfer a sheet at a speed specified according to print conditions. To a sheet transferred by using the transfer belt 120, the print heads 2 discharge inks of respective colors, and thereby color print, monochrome print or gray-scale print is performed.

A printed sheet is transferred along the paper discharging-system transfer path by the driving unit, and then directly guided to the paper receiving table 110 in the case of single side printing. Meanwhile, in the case of double side printing, a single-side printed sheet is guided to a switchback path 111 from the paper discharging-system transfer path through a switching unit 122, and the sheet is again returned to the paper feeding-system transfer path with the printed side reversed. In the same manner as in the case of single side printing, the sheet thus returned to the paper feeding-system transfer path is transferred to the print unit from the resister 121, subjected to printing, and then discharged to the paper receiving table 110 through the paper discharging-system transfer path.

Configuration of Ink Circulation System

Figure 1:
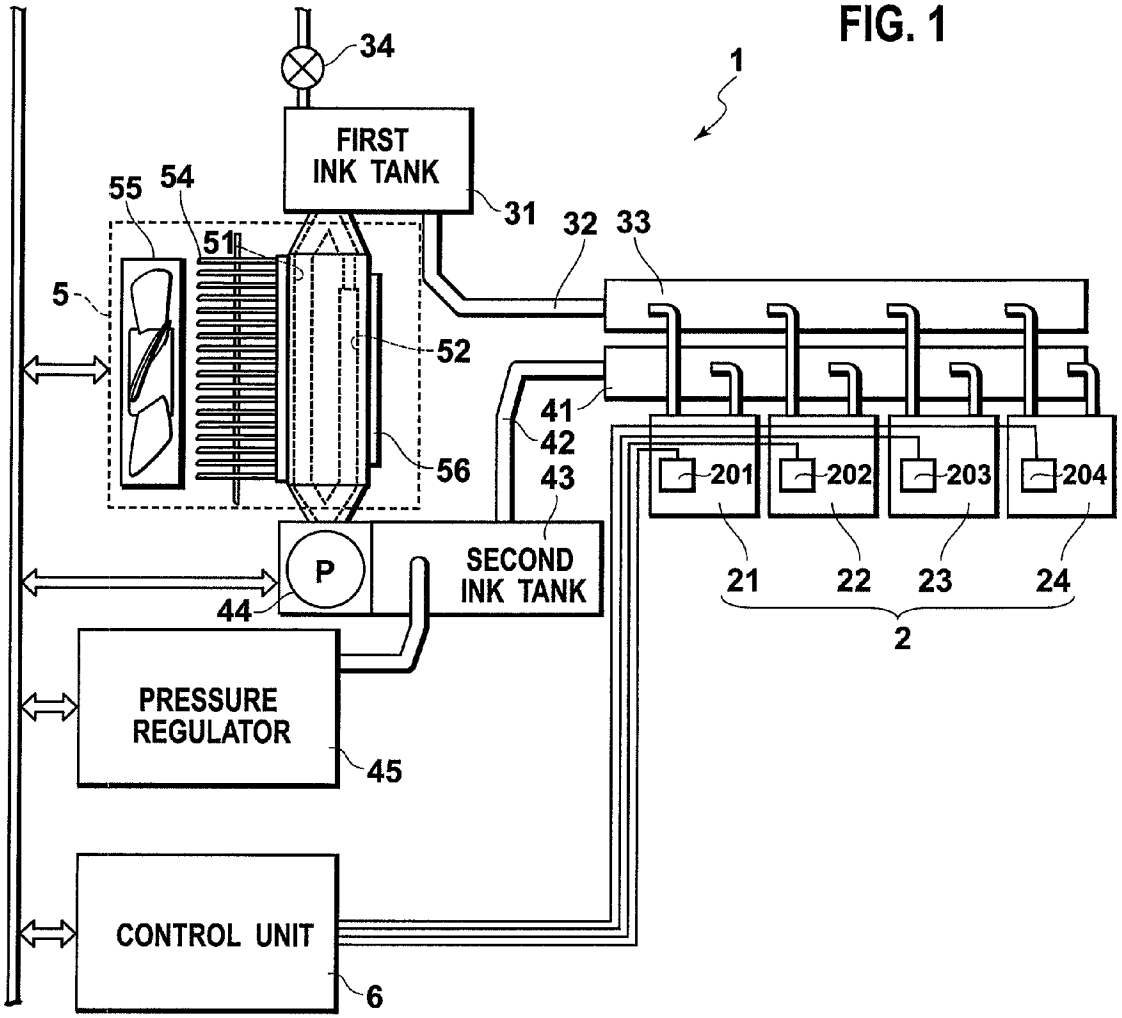
FIG. 1 is a block diagram of an ink circulating system of an inkjet printer according to a first embodiment of the present invention.

The inkjet printer 10 according to the first embodiment includes an ink circulation system 1 shown in FIG. 1. The ink circulation system 1 includes: the inkjet-type print heads 2 described in FIG. 2 as above; a first ink circulation path 32 which has one end thereof connected to the print heads 2 and is configured to supply ink to the print heads 2; a second ink circulation path 42 which has one end thereof connected to the print heads 2 and is configured to circulate ink discharged from the print heads 2; and an ink temperature adjusting unit 5. The ink temperature adjusting unit 5 has one end thereof connected to the other end of the second ink circulation path 42, and the other end thereof connected to the other end of the first ink circulation path 32. The ink temperature adjusting unit 5 includes a first temperature-adjusting path 51 which is configured to be used for cooling the ink, and a second temperature-adjusting path 52 which is configured to be used for heating the ink. The second temperature-adjusting path 52 has one end thereof connected to the other end of the second ink circulation path 42 as branching off from the first temperature-adjusting path 51, has the other end thereof connected to the other end of the first ink circulation path 32 as coming together with the first temperature-adjusting path 51, and has a higher flow path resistance at least on the first ink circulation path 32 side than a flow path resistance of the first temperature-adjusting path 51.

The ink circulation system 1 shown in FIG. 1 is for a single color. Since the inkjet printer 10 according to the first embodiment is a color inkjet printer, three of the same ink circulation systems 1, although not shown in the drawing, are installed in addition; therefore, the inkjet printer 10 has a total of four ink circulation systems 1 installed therein.

Further, the ink circulation system 1 includes a first ink tank (upstream tank) 31, which is connected to the other end of the first ink circulation path 32, and configured to store ink supplied to the print heads 2 through the first ink circulation path 32, and a second ink tank (downstream tank) 43, which is connected to the other end of the second ink circulation path 42, and is configured to store ink discharged from the print heads 2 to be circulated through the second ink circulation path 42. Ink having a temperature adjusted through the ink temperature adjusting unit 5 so as to obtain a good print result circulates into the first ink tank 31 to be stored. The first ink tank 31 is provided with a relief valve 34 which is configured to adjust the pressure of ink circulating therein. The first ink tank 31 has a function of maintaining the flow rate and pressure of ink supplied to the print heads 2 constant. In the second ink tank 43, surplus ink which has not been used for printing in the print heads 2 is collected and stored. Between the second ink tank 43 and the ink temperature adjusting unit 5, an ink circulating pump 44 is arranged. The ink circulating pump 44 is configured to push up the ink collected in the second ink tank 43 to the first ink tank 31 through the ink temperature adjusting unit 5. Further, a pressure regulator 45 is connected to the second ink tank 43. The second ink tank 43, like the first ink tank 31, has a function of maintaining the flow rate and pressure of circulating ink.

Incidentally, although not shown in the drawing, an ink bottle which is connected to the second ink circulation path 42 or the second ink tank 43 may be arranged in the ink circulation system 1 according to the first embodiment. The ink bottle has a function of replenishing ink when the amount of circulating ink is reduced.

The print heads 2 is formed of four heads 21, 22, 23 and 24, although not limited to this number, and these heads 21 to 24 are connected to one end of the first ink circulation path 32 in parallel through an ink distributor 33. The ink distributor 33 has a function of supplying ink evenly to the heads 21 to 24 from the first ink circulation path 32. Further, the heads 21 to 24 are each connected to one end of the second ink circulation path 42 through an ink collector feeder 41. The ink collector feeder 41 has a function of collecting surplus ink which is not used in the heads 21 to 24 and supplying the ink to the second ink circulation path 42.

The heads 21 to 24 forming the print heads 2 are respectively provided with temperature detection sensors 201 to 204. The temperature detection sensors 201 to 204 are connected to a control unit 6. The temperature detection sensors 201 to 204 have a function of detecting the temperatures of ink at the heads 21 to 24, respectively, and the detected temperatures are monitored by the control unit 6. Incidentally, the temperature detection sensors 201 to 204 are provided to the heads 21 to 24 in order to most accurately measure the temperature of ink immediately before or after printing. When accuracy tolerance in temperature measurement is allowed to some extent, the temperature detection sensor may be provided to at least any one of the ink distributor 33, the ink collector feeder 41, the first ink circulation path 42, the first ink tank 31, the second ink circulation path 42, the second ink tank 43, and the like.

In the ink circulation system 1, the ink temperature adjusting unit 5 is provided between the first ink tank 31 and the second ink tank 43, more specifically between the first ink tank 31 and the second ink tank 43 through the ink circulating pump 44 in between. The first temperature-adjusting path 51 and the second temperature-adjusting path 52 in the ink temperature adjusting unit 51 are connected to the first ink circulation path 32 through the first ink tank 31, and also connected to the second ink circulation path 42 through the second ink tank 43.

The ink temperature adjusting unit 5 has therein a heating unit 56 and cooling units 54 and 55. The heating unit 56 is arranged, on the opposite side from the first temperature-adjusting path 51 (on the right side in FIG. 1), along the second temperature-adjusting path 52, and has a function of heating ink circulating inside the second temperature-adjusting path 52. Although not limited to such a configuration, in the first embodiment, a thin sheet-type heating heater is used for the heating unit 56 in order to make the ink temperature adjusting unit 5 smaller. The heating unit 56 is connected to the control unit 6. The control unit 6 is configured to perform on and off control of the heating unit 56 in accordance with the temperature of ink measured by using the ink temperature detecting sensors 201 to 204 provided to the respective print heads 2.

In the ink temperature adjusting unit 5 according to the first embodiment, a heat sink (a radiation fin in the present embodiment) made with aluminum, copper, or an alloy thereof, which has high thermal conductivity, is used for the cooling unit 54, and a cooling fan which is configured to forcibly discharge heat released from the cooling unit 54 to the outside of the inkjet printer 10 is used for the cooling unit 55. The cooling unit 54 is arranged, on the opposite side from the second temperature-adjusting path 52 (on the left side in FIG. 1), along the first temperature-adjusting path 51, and has a function of cooling ink circulating inside the first temperature-adjusting path 51. The cooling unit 55 has the cooling unit 54 between itself and the first temperature-adjusting path 51, is arranged along the first temperature-adjusting path 51, and has a function of cooling ink circulating inside the first temperature-adjusting path 51. The cooling unit 55 is connected to the control unit 6. The control unit 6 is configured to perform on and off control of the cooling unit 55 in accordance with the temperature of ink measured by using the ink temperature detecting sensors 201 to 204 provided to the respective print heads 2.

It should be noted that the cooling units 54 and 55 are not necessarily limited to these examples, and a cooling unit based on a water-cooling system, a cooling unit based on an electric system, or the like may be adopted. Further, a cooling system based on a combination of these systems may be also adopted.

Ink Circulation Operation of Ink Circulation System

Overall ink circulation operation of the ink circulation system 1 shown in FIG. 1 is as follows.

Firstly, ink stored in the first ink tank 31 is supplied to each of the heads 21 to 24 forming the print heads 2 through the first ink circulation path 32 and then the ink distributor 33. Ink stored in the first ink tank 31 is ink which circulated through the ink temperature adjusting unit 5, and has a temperature at which a good print result can be obtained.

In the print heads 2, ink supplied for performing printing on a sheet is consumed. Surplus ink which has not been used for the printing is collected through the ink collector feeder 41, and thus collected ink is collected through the ink circulation path 42 and stored in the second ink tank 43.

The ink stored in the second ink tank 43 is sequentially sent to the ink temperature adjusting unit 5 through the ink circulating pump 44. At this point, the ink temperature detecting sensors 201 to 204 provided to the respective print heads 2 are configured to measure the temperature of the circulating ink, and then send the result to the control unit 6. The control unit 6 is configured to determine whether or not this measurement result of the temperature of the ink is a temperature at which a good print result can be obtained, and perform control on the cooling unit 55 or the heating unit 56 on the basis of the result of the determination. When the temperature of ink is too low to be within a range which guarantees a good print result, the control unit 6 is configured to drive the heating unit 56, so that the temperature of the ink passing through the ink temperature adjusting unit 5 is adjusted to be higher. On the contrary, when the temperature of ink is too high, the temperature of the ink passing through the ink temperature adjusting unit 5 is adjusted to be lower by the cooling units 54 and 55. Incidentally, in this case, two kinds of cooling units 54 and 55 are used, and cooling may be performed by the cooling unit 54 without operating the cooling unit 55, depending on the temperature of ink circulating in the ink temperature adjusting unit 5 and the ambient temperature.

The ink whose temperature has been adjusted in the ink temperature adjusting unit 5 is circulated back to the first ink tank 31, and stored in the first ink tank 31.

Configuration of Ink Temperature Adjusting Unit

As shown in FIG. 1 described above, the ink temperature adjusting unit 5 according to the first embodiment has the first temperature-adjusting path 51, the second temperature-adjusting path 52, the cooling units 54 and 55, and the heating unit 56. In this case, at least one of the cooling units 54 and 55 and the heating unit 56 may be provided as an external device of the ink temperature adjusting unit 5.

Figure 3:
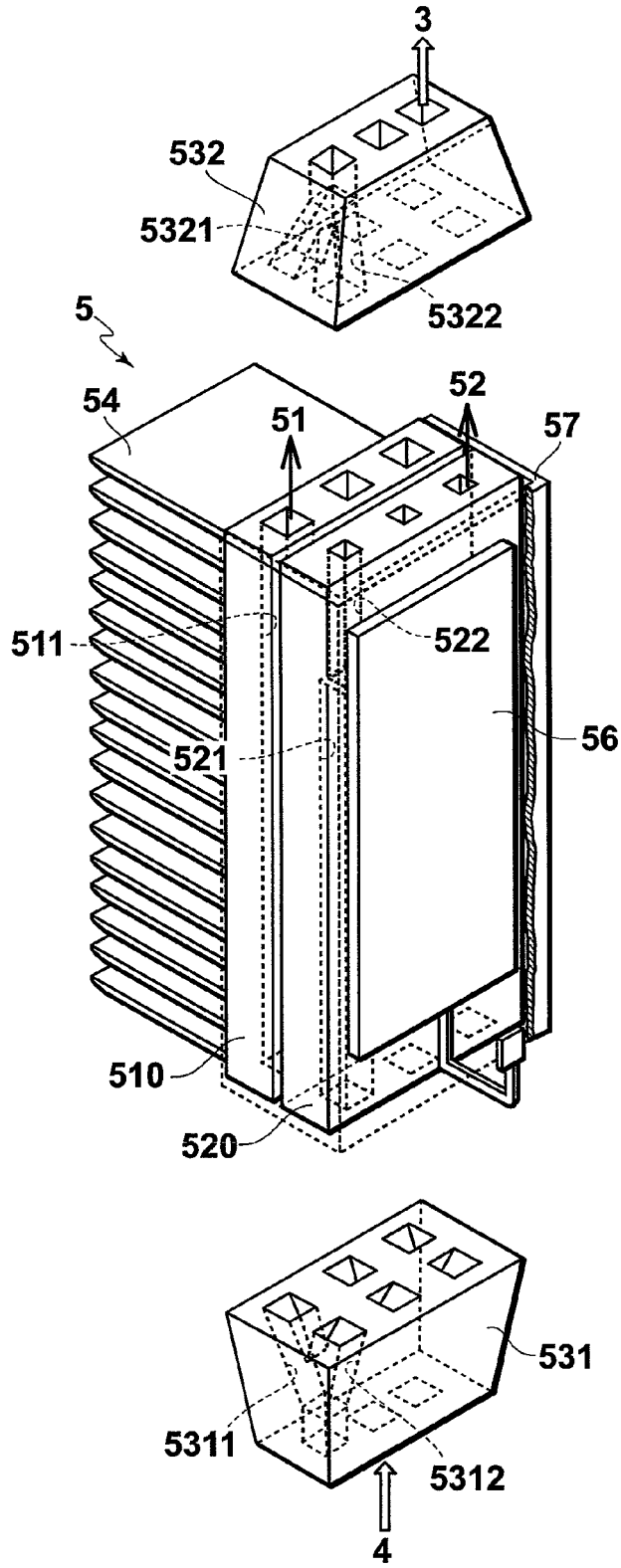
FIG. 3 is an exploded perspective view of an ink temperature adjusting unit installed in the ink circulation system shown in FIG. 1.
Figure 4A:
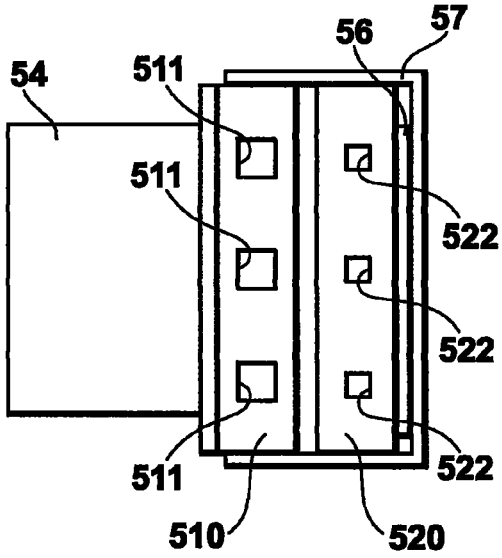
Figure 4B:
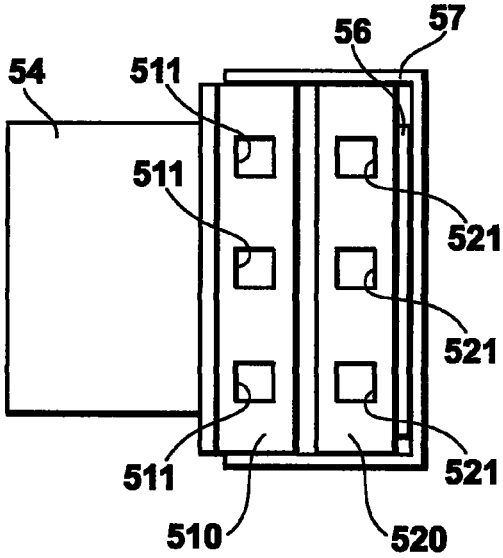
FIG. 4B is a bottom view of the main portion of the same ink temperature adjusting unit shown in FIG. 3.

As shown in FIG. 3, FIG. 4A and FIG. 4B, the ink temperature adjusting unit 5 according to the first embodiment includes a first heat exchanging block 510, a second heat exchanging block 520, an confluence unit 532, and a branching unit 531. The first heat exchanging block 510 has a first heat exchanging path 511 therein which extends from a first surface on the first ink circulating path 32 side (upper-side front surface in FIG. 3) to a second surface on the second ink circulating path 42 side (lower-side rear surface in FIG. 3). The first heat exchanging block 510 is formed into the shape of a rectangular parallelepiped, in this embodiment, having a large contact surface with the cooling unit 54 and a short distance between the first heat exchanging path 511 and the cooling unit 54 so as to be able to efficiently heat the ink flowing in the first heat exchanging path 511 to the cooling unit 54. The first heat exchanging block 510 is preferably made of a metal, such as aluminum, copper, and an alloy thereof, which has high thermal conductivity, but is not limited thereto. Three first heat exchanging paths 511 are arranged in parallel to each other in this description, although the number thereof is not limited thereto. The first heat exchanging path 511 is a through hole having a square opening and a uniform cross section in this description. The first heat exchanging block 510 is manufactured by casting, especially an aluminum die casting method, in the case of using aluminum or an alloy thereof, for example, as a material.

The second heat exchanging block 520 has a second heat exchanging path 521 therein which extends from a third surface (upper-side front surface in FIG. 3) on the first ink circulation path 32 side to a fourth surface (lower-side rear surface in FIG. 3) on the second ink circulation path 42 side. The second heat exchanging block 520 is formed into the shape of a rectangular parallelepiped in this embodiment, similarly to the first heat exchanging block 510, having a large contact surface with the heating unit 56 and a short distance between the second heat exchanging path 521 and the heating unit 56, so that heat from the heating unit 56 can be efficiently transmitted to ink flowing in the second heat exchanging path 521 (and 522) and thereby heat the ink. In the present embodiment, the external diameter of the first heat exchanging block 510 is set to be equivalent to the external diameter of the second heat exchanging block 520. The second heat exchanging block 520 is made of a material similar to the material of the first heat exchanging block 510. Further, similarly to the first heat exchanging path 511, three second heat exchanging paths 521 are arranged in parallel to each other, although the number thereof is not limited thereto. In the present embodiment, the second heat exchanging path 521 is a through hole having a square opening, which is the same in shape as the opening of the first heat exchanging path 511 and equivalent thereto in size, and a uniform cross section, in a section from the fourth surface on the second ink circulation path 42 side to a point before reaching the third surface. The second heat exchanging block 520 is manufactured with a similar material as that of the first heat exchanging block 510 by a similar processing method.

In the second heat exchanging block 520, in a section from the point before reaching the third surface of the second heat exchanging path 521 to the third surface, that is, a portion of the second heat exchanging path 521 on the first ink circulation path 32 side, a resistance path 522 is arranged which is configured to increase a flow-path resistance of the second heat exchanging path 521. The ink temperature adjusting unit 5 according to the first embodiment employs a mechanism in which ink is circulated simultaneously in the first temperature-adjusting path 51 and the second temperature-adjusting path 52 during circulation of the ink, and therefore ink is always being circulated (flowing) in the first temperature-adjusting path 51 and the second temperature-adjusting path 52. With the resistance path 522 provided to the second temperature-adjusting path 52, the flow path resistance of the second temperature-adjusting path 52 is higher than the flow path resistance of the first temperature-adjusting path 51, in the case where the temperatures of the inks circulating in the first temperature-adjusting path 51 and the second temperature-adjusting path 52 are equal to each other. Further, with the resistance path 522 provided to the second temperature-adjusting path 52, the flow rate of the ink circulating in the second temperature-adjusting path 52 is larger than the flow rate of the ink circulating in the first temperature-adjusting path 51, in the case where the temperature of the ink circulating in the second temperature-adjusting path 52 is higher by a prescribed number of degrees than the temperature of the ink circulating in the first temperature-adjusting path 51.

The ink temperature adjusting unit 5 according to the first embodiment has a function of allowing self adjustment by ink itself of the flow rates thereof circulating in the first temperature-adjusting path 51 and the second temperature-adjusting path 52 by adjusting the temperatures of inks circulating the first temperature-adjusting path 51 and the second temperature-adjusting path 52, respectively, on the basis of the characteristics of ink of reducing its flow path resistance as the temperature of the ink increases. In other words, the ink temperature adjusting unit 5 has the following function. The ink temperature adjusting unit 5 automatically increases the flow rate of the ink circulating in the first temperature-adjusting path 51 used for cooling the ink, when the temperature of the ink is higher than the temperature range in which a good print result can be obtained, and automatically increases the flow rate of the ink circulating in the second temperature-adjusting path 52 used for heating the ink, when the temperature of the ink is lower than the temperature range in which a good print result can be obtained. Accordingly, it is not necessary to assemble mechanical means, such as a solenoid valve, and a control system to control a solenoid valve, for the adjustment of the flow rate of the ink circulating the first temperature-adjusting path 51 and the second temperature-adjusting path 52.

The resistance path 522 according to the first embodiment is formed into a similar shape having the same square shape as the shape of the opening of the second heat exchanging path 521 and a size smaller than the opening, and has a uniform cross section along the path. A modification example of the resistance path 522 will be described later.

The confluence unit 532 of the ink temperature adjusting unit 5 is provided on the first surface of the first heat exchanging block 510 and the third surface of the second heat exchanging block 520, that is, in an upper portion in FIG. 3. The confluence unit 532 has a first confluence path 5321, which connects the first heat exchanging path 511 and the first ink circulation path 32 (in reality, the first ink tank 31), and a second confluence path 5322, which connects the second heat exchanging path 521 (in reality, the resistance path 522 thereof) and the first ink circulation path 32 (in reality, the first ink tank 31). The confluence unit 532 has a function of merging ink circulating in the first heat exchanging path 511 and ink circulating in the second heat exchanging path 521 together, and circulating thus-merged ink whose temperature has been adjusted in the first ink tank 31. The confluence unit 532 is formed into the shape of a trapezoid, in which the area of a bottom side located on the first heat exchanging block 510 side and the second heat exchanging block 520 is larger than the area of an upper side located on the first ink circulation path 32 side. As having a complicated inner shape in which two paths, the first confluence path 5321 and the second confluence path 5322, are merged into one, the confluence unit 532 according to the first embodiment is manufactured with a resin material, for example, which allows easy manufacture, in a molding method using a die. For attachment of the confluence unit 532 to the first heat exchanging block 510 and the second heat exchanging block 520, a gasket which prevents ink leakage or an adhesive agent which has a function of gasket is used.

The branching unit 531 is provided on the second surface of the first heat exchanging block 510 and the fourth surface of the second heat exchanging block 520, that is, in a lower side portion in FIG. 3. The branching unit 531 has a first branching path 5311, which connects the first heat exchanging path 511 and the second ink circulation path 42 (in reality, the ink circulating pump 44), and a second branching path 5312 which connects the second heat exchanging path 52 and the second ink circulation path 42 (in reality, the ink circulating pump 44). The branching unit 531 has a function of dividing ink to be circulated from the second ink circulation path 42 to the first heat exchanging path 511 from ink to be circulated in the second heat exchanging path 521. The branching unit 531 is formed into the shape of a trapezoid, in which the area of a bottom side located on the first heat exchanging block 510 side and the second heat exchanging block 520 is larger than the area of an upper side located on the second ink circulation path 42 side. As having a complicated inner shape in which two paths, the first branching path 5311 and the second branching path 5312, are merged into one, the branching unit 531 according to the first embodiment is manufactured, similarly to the confluence unit 532, with a resin material, for example, in a similar method. A method of attachment of the branching unit 531 to the first heat exchanging block 510 and the second heat exchanging block 520 is similar to the method of attachment of the confluence unit 532.

The first temperature-adjusting path 51, which is configured to be used for cooling ink, in the ink temperature adjusting unit 5 according to the first embodiment is formed by connecting the first branching path 5311 of the branching unit 531, the first heat exchanging path 511 of the first heat exchanging block 510, and the first confluence path 5321 of the confluence unit 532. Similarly, the second temperature-adjusting path 52 which is configured to be used for heating ink is formed by connecting the second branching path 5312 of the branching unit 531, the second heat exchanging path 521 and the resistance path 522 of the second heat exchanging block 520, and the second confluence path 5322 of the confluence unit 532.

Being arranged apart from each other with an appropriate space in between, the first heat exchanging block 510 and the second heat exchanging block 520 in this state are clamped together by a holder 57. Air having low thermal conductivity goes into the space between the first heat exchanging block 510 and the second heat exchanging block 520, and these are thermally isolated from each other by this air. In other words, heat exchange is unlikely to occur between the first heat exchanging block 510 and the second heat exchanging block 520; therefore, both cooling efficiency and heating efficiency of the ink can be improved.

The holder 57 extends along two opposed lateral surfaces of the first heat exchanging block 510, two opposed lateral surfaces of the second heat exchanging block 520, and a lateral surface, which is located on the heating unit 56 side, of the second heat exchanging block 520. The holder 57 has a squared U shape when viewed from the top. The holder 57 is arranged in such a manner as to surround the heating unit 56 located between the holder 57 and the second heat exchanging block 520, and configured to efficiently transfer heat generated from the heating unit 56 to the second heat exchanging block 520. The holder 57 is manufactured by performing a bending process on a metal material, for example. Alternatively, the holder 57 may be manufactured from a resin material, for example, by molding.

Ink Circulation Operation of Ink Temperature Adjusting Unit

Figure 5C:
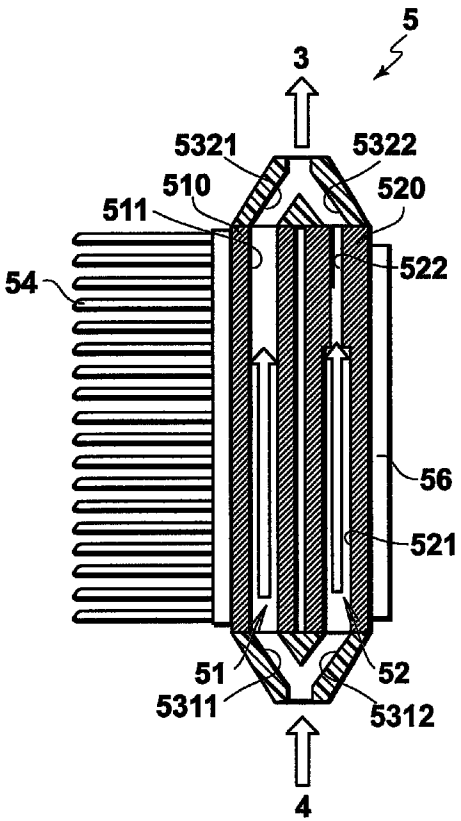
FIG. 5C is a cross-sectional view describing a state of ink circulating while being cooled in the same ink temperature adjusting unit.

Overall ink circulation operation of the ink temperature adjusting unit 5 according to the first embodiment is as follows. The ink temperature adjusting unit 5 shown in FIG. 5A is in a state where none of the heating unit 56 and the cooling units 54 and 55 is in operation. The ink collected from the print heads 2 flows into the ink temperature adjusting unit 5 through all of the second ink circulation path 42, the second ink tank 43 and the ink circulating pump 44. The ink flows into the branching unit 531 of the ink temperature adjusting unit 5, and is circulated to the first ink tank 31 through the first temperature-adjusting path 51 which is formed with the first branching path 5311 of the branching unit 531, the first heat exchanging path 511 of the first heat exchanging block 510, and the first confluence path 5321 of the confluence unit 532. In the meantime, the ink that has flown into the branching unit 531 flows into the second branching path 5312 thereof, and is merged into the ink flowing to the first temperature-adjusting path 51 through the second temperature-adjusting path 52 which is formed with the second heat exchanging path 521 of the second heat exchanging block 520, the resistance path 522, and the second confluence path 5322 of the confluence unit 532, and then circulated to the first ink tank 31.

At this point, if there is almost no difference between the temperatures of the inks flowing in the first temperature-adjusting path 51 and the second temperature-adjusting path 52, respectively, the flow rate of the ink flowing in the second temperature-adjusting path 52 is smaller than the flow rate of the ink flowing in the first temperature-adjusting path 51 because the resistance path 522 is provided to the second temperature-adjusting path 52.

Figure 5B:
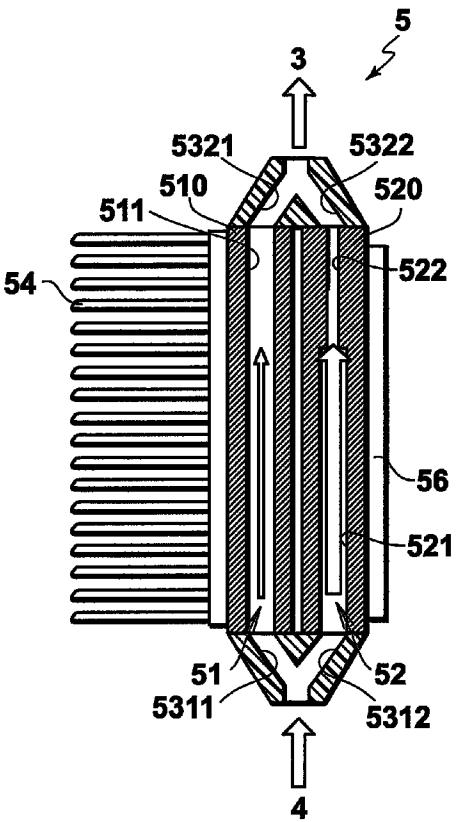
FIG. 5B is a cross-sectional view describing a state of ink circulating while being heated in the same ink temperature adjusting unit.
Figure 5A:
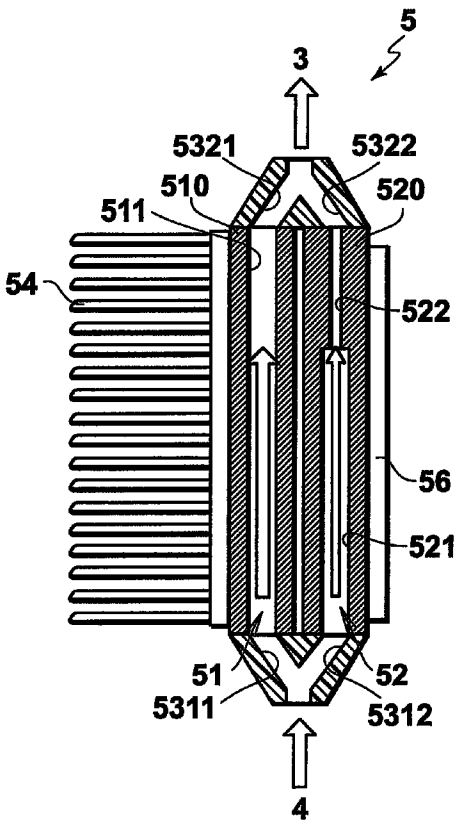
FIG. 5A is a cross-sectional view describing a state of ink circulating at a constant temperature in the ink temperature adjusting unit shown in FIG. 3.

The ink temperature adjusting unit 5 shown in FIG. 5B is in a state where the heating unit 56 is in operation. To be more specific, when the temperature of the ink is too low to be in a range of temperature at which a good print result cannot be obtained, the ink temperature adjusting unit 5 heats the ink using the heating unit 56. In the ink temperature adjusting unit 5 shown in FIG. 5A, the resistance path 522 is provided in the vicinity of the outlet (a portion on the first ink circulation path 32 side) of the second heat exchanging path 521 of the second temperature-adjusting path 52. Accordingly, the flow speed of the ink flowing in the second heat exchanging path 521 leading to the vicinity of the outlet is slower than the flow speed of the ink flowing in the first heat exchanging path 511. In other words, the period of time when the ink stays in the second path 52 for temperature control becomes longer. When the ink in this state is heated by the heating unit 56, the ink flowing in the second temperature-adjusting path 52 can be efficiently heated.

As the temperature of the ink goes up by the operation of the heating unit 56, the viscosity of the ink goes down, thereby reducing the flow path resistance of the ink. Accordingly, as shown in FIG. 5B, the flow rate of the ink flowing in the resistance path 522 increases, resulting in an increase in the flow rate of the ink flowing in the second temperature-adjusting path 52. In other words, it is possible to improve the circulation of the ink flowing in the second temperature-adjusting path 52, thereby raising the temperature of the ink by using the heating unit 56 at an accelerating rate.

The ink temperature adjusting unit 5 shown in FIG. 5C is in a state where the cooling unit 54 is in use or the cooling unit 54 is in operation in combination with the cooling unit 55. To be more specific, the temperature of ink goes up as the operation of the heating unit 56 proceeds, or goes up due to heat generated by operation of the print heads 2 and inkjet printer 10 due to continuous execution of print operation. When the temperature of the ink goes above the temperature range in which a good print result can be obtained in this way, the ink temperature adjusting unit 5 cools the ink by using the cooling unit 54 or the cooling units 54 and 55.

For example, in the ink temperature adjusting unit 5 shown in FIG. 5B, when the temperature of the ink exceeds the temperature range in which a good print result can be obtained, the cooling unit 54 or the cooling unit 54 in combination with the cooling unit 55 starts to operate, so that the ink flowing in the first temperature-adjusting path 51 is cooled. In addition, since operation of the heating unit 56 is to be stopped or is stopped, the ink flowing in the second temperature-adjusting path 52 is cooled. When the temperature of the ink flowing in the second temperature-adjusting path 52 goes down, the viscosity of the ink increases; therefore, the flow path resistance of the ink increases. The ink temperature adjusting unit 5 comes close to the state shown in FIG. 5A described above. With the resistance path 522 provided in the vicinity of the outlet of the second heat exchanging path 521 of the second temperature-adjusting path 52, the flow of ink in the resistance path 522 is suppressed, and, in turn, the flow rate of ink flowing in the first temperature-adjusting path 51 increases as shown in FIG. 5C. In other words, the flow rate of the ink flowing in the first temperature-adjusting path 51 increases, and heat from the ink is transmitted to the cooling units 54 and 55 in the first temperature-adjusting path 51 (heat exchange occurs); therefore, the ink can be efficiently cooled.

As described above, the ink temperature adjusting unit 5 has the first temperature-adjusting path 51 and the second temperature-adjusting path 52 which branch off from the second ink circulation path 42 and come together in the first ink circulation path 32. Further, in the ink temperature adjusting unit 5, the resistance path 522 is provided to the second temperature-adjusting path 52. Accordingly, in the ink temperature adjusting unit 5, based on the characteristics of ink of reducing the flow path resistance as the temperature of the ink goes up, the ink temperature adjusting unit 5 allows self adjustment of the circulation flow rate of ink flowing in the first temperature-adjusting path 51 and the second temperature-adjusting path 52 (ink itself can automatically adjust the flow rate). In other words, the ink temperature adjusting unit 5 increases the flow rate of ink flowing in the first temperature-adjusting path 51, which is configured to be used for cooling, by the self adjustment to thereby enhance the cooling efficiency, when the temperature of the ink is high. When the temperature of the ink is low, the ink temperature adjusting unit 5 increases the flow rate of the ink flowing in the second temperature-adjusting path 52, which is configured to be used for heating, by the self adjustment to enhance the heating efficiency. Relationship between the flow rate of ink and the flow path resistance in the ink temperature adjusting unit Next, in the ink temperature adjusting unit 5 according to the first embodiment, one example of the specific relationship between the flow rate of the ink flowing in the first temperature-adjusting path 51 and the second temperature-adjusting path 52 and the resistance path 522 is as follows.

Figure 6A:
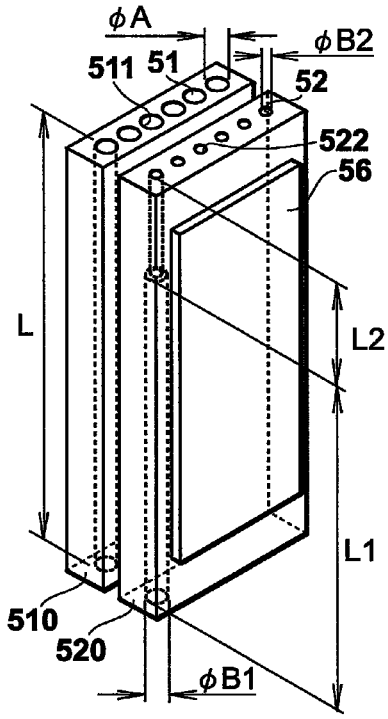
Figure 6B:
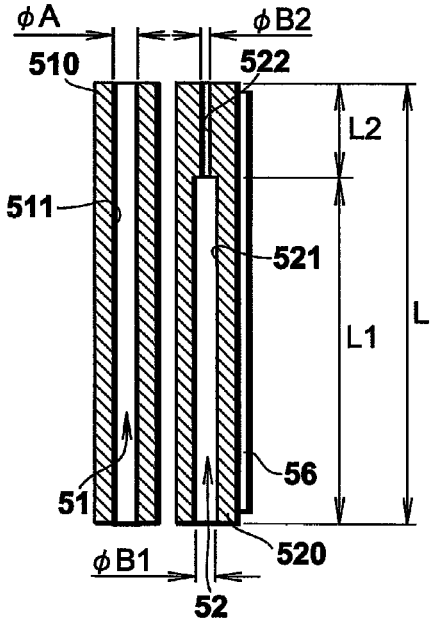
FIG. 6B is a cross-sectional view of the model.

In the ink temperature adjusting unit (model) 5 used for calculation in this section, as shown in FIG. 6A and FIG. 6B, the first heat exchanging block 510 which is configured to be used for cooling has a length L in an ink circulation direction, and the shape of an opening of the first heat exchanging path 511 of the first temperature-adjusting path 51 is set to be circular and a diameter thereof is ΦA. In the first heat exchanging block 510, a total of six heat exchanging paths 511 are arranged in parallel to each other at equal intervals. The first heat exchanging block 510 is expressed as "heat exchanger A" in the description below based on FIGS. 8A and 8B and FIGS. 9A and 9B.

Meanwhile, the length of the second heat exchanging block 520, which is configured to be used for heating, in an ink circulation direction is L as in the first heat exchanging block 510. The length from the fourth surface of the second heat exchanging path 521 of the second temperature-adjusting path 52 is L1, the shape of an opening of the second heat exchanging path 521 is set to be circular, and the diameter thereof is ΦB1. The length from the third surface of the resistance path 522 provided to the second heat exchanging path 521 is L2, the shape of an opening of the resistance path 522 is set to be circular, and the diameter thereof is ΦB2. In the second heat exchanging block 520, a total of six second heat exchanging paths 521 is arranged in parallel to each other at equal intervals, and a total of six resistance paths 522 is similarly arranged in parallel to each other at equal intervals in such a manner as to be directly connected to the second heat exchanging paths 521. The second heat exchanging block 520 is expressed as "heat exchanger B" in the description below based on FIGS. 8A and 8B and FIGS. 9A and 9B.

In the ink circulation system 1 according to the first embodiment, as shown in FIG. 7, the ink used has a nature of decreasing the viscosity (mPa·s) thereof as the temperature (° C.) thereof goes up. For example, in the case where the environmental temperature at which the inkjet printer 10 can be used is set to 10° C. to 35° C., the viscosity of ink when the temperature thereof is 10° C. is 18.0 mPa·s, whereas the viscosity of ink when the temperature thereof goes up to 35° C. is 7.4 mPa·s.

In each of the first heat exchanging path 511, the second heat exchanging path 521, and the resistance path 522, the ink flow rate (mL/s) and the flow path resistance (Pa·s/m$^3$) are calculated according to the procedure below. First, the pressure loss within a laminar circular pipe of the path is calculated according to the following equation (1).

$$\Delta P=8\cdot\mu\cdot u\cdot l/r^2 \quad (1)$$

Here, in the equation (1), ΔP represents pressure difference, μ represents a viscosity coefficient, u represents an average flow rate, l represents a path length (L, L1 or L2), and r represents a radius (ΦA/2, ΦB1/2 or ΦB2/2). The flow rate inside the circular pipe in the path is calculated according to the following equation (2).

$$Q=u\cdot A=u\cdot(\pi\cdot r^2) \quad (2)$$

In the equation (2), Q represents the flow rate within the path, and A represents a cross-sectional area in the circular pipe of the path. The equation (2) used for the calculation of the flow rate can be expressed by the following equation (3) including the pressure loss and flow path resistance of the path.

$$Q=\Delta P/R \quad (3)$$

In the equation (3), R represents the flow path resistance of the path. By substituting the equations (1) and (2) into the equation (3) and expanding the result, the flow path resistance can be calculated according to the following equation (4).

$$R=8\cdot\mu\cdot l/(\pi\cdot r^4) \quad (4)$$

Using the above equations, temperature dependencies of the flow rate of the ink circulating in the first heat exchanging path 511 and the second heat exchanging path 521 of the ink temperature adjusting unit 5 and the flow path resistance can be calculated as shown in FIGS. 8A and 8B. Here, the length L of the first heat exchanging path 511 of the heat exchanger A (the first heat exchanging block 510) is set to 300 mm, and the diameter ΦA thereof is set to 4 mm. The length L1 of the second heat exchanging path 521 of the heat exchanger B (the second heat exchanging block 520) is set to 190 mm, and the diameter ΦB1 thereof is set to 4 mm. The length L2 of the resistance path 522 is set to 110 mm, and the diameter ΦB2 thereof is set to 3.9 mm. In FIGS. 8A and 8B, the horizontal columns respectively represent the flow path resistances (Pa·s/m$^3$) relative to the temperature increase which changes in a stepwise manner (here, by 5° C.). This temperature represents the temperature of the ink entering the ink temperature adjusting unit 5. The vertical columns respectively represent a sum of the flow path resistances (Pa·s/m$^3$) of both of the paths, the flow rate of the heat exchanger A (mL/s), the flow rate of the heat exchanger B (mL/s), and the ratio of the flow rate of the heat exchanger B to the flow rate of the heat exchanger A set to 1 (B/A). Under the respective items of flow path resistance, flow rate and ratio of flow rate, results are shown which are calculated respectively for temperature differences between the inks circulating in the first temperature-adjusting path 51 and the second temperature-adjusting path 52, that is, specifically, for 0° C. (the same temperature), 5° C., 10° C., 15° C. and 20° C. The temperature difference is a difference in temperature between the ink coming out from the first temperature-adjusting path 51 and the ink coming out from the second temperature-adjusting path 52.

(1) Relationship Between the Flow Rate of Ink and the Flow Path Resistance when the Temperature of the Ink is the Same (at a Low Temperature)

When the ink temperature adjusting unit 5 is in the state shown in FIG. 5A as described, the temperature of the ink in the path of the ink circulation system 1 is 10° C., the temperature of the ink circulating in the first heat exchanging path 511 of the heat exchanger A of the ink temperature adjusting unit 5 is 10° C., and the temperature of the ink circulating in the second heat exchanging path 521 of the heat exchanger B is the same at 10° C., the following calculation results can be obtained.

Flow path resistance of 6 first heat exchanging paths 511: $1.433\times10^{-4}$ Pa·s/m$^3$ Flow path resistance of 6 second heat exchanging paths 521: $9.077\times10^{-5}$ Pa·s/m$^3$ Flow path resistance of 6 resistance paths 522: $5.815\times10^{-5}$ Pa·s/m$^3$ Sum of flow path resistances: $7.303\times10^{-5}$ Pa·s/m$^3$ Flow rate of the heat exchanger A: 1.529 mL/s Flow rate of the heat exchanger B: 1.471 mL/s Ratio of flow rate: 0.96

According to these calculation results, when the temperatures of the inks flowing in the first heat exchanging path 511 and the second heat exchanging path 521, respectively, in the ink temperature adjusting unit 5 are equal to each other, the flow rate of ink flowing in the second heat exchanging path 521 is smaller because there is a flow path resistance attributed to the resistance path 522. The flow rate of the ink flowing in the second heat exchanging path 521 is 0.96 times the flow rate of the ink flowing in the first heat exchanging path 511.

(2) Relationship Between the Flow Rate of Ink and the Flow Path Resistance when the Ink is Heated When the ink temperature adjusting unit 5 is in the state shown in FIG. 5B as described, the temperature of the ink in the path of the ink circulation system 1 is 10° C. and the temperature of the ink circulating in the second heat exchanging path 521 of the heat exchanger B of the ink temperature adjusting unit 5 is raised by 15° C. to reach 25° C. by putting the heating unit 56 into operation, the following calculation results can be obtained.

Sum of flow path resistances: $6.625\times10^{-5}$ Pa·s/m$^3$

Flow rate of the heat exchanger A: 1.387 mL/s

Flow rate of the heat exchanger B: 1.613 mL/s

Ratio of flow rate: 1.16

According to these calculation results, in the ink temperature adjusting unit 5, when the heating unit 56 is put into operation, and thereby the second temperature-adjusting path 52 is heated, the viscosity of the ink flowing in the second temperature-adjusting path 52 including the resistance path 522 decreases, the flow path resistance decreases, and therefore the flow rate of the ink flowing in the second heat exchanging path 521 increases. Accordingly, the flow rate of the ink flowing in the first heat exchanging path 511 relatively decreases. The flow rate of the ink flowing in the second heat exchanging path 521 reaches 1.16 times the flow rate of the ink flowing in the first heat exchanging path 511.

(3) Relationship Between the Flow Rate of Ink and the Flow Path Resistance when the Temperature of the Ink is the Same (at a High Temperature)

When the ink temperature adjusting unit 5 is in the state shown in FIG. 5A as described, the temperature of the ink in the path of the ink circulation system 1 is 40° C., the temperature of the ink circulating in the first heat exchanging path 511 of the heat exchanger A of the ink temperature adjusting unit 5 is 40° C., and the temperature of the ink circulating in the second heat exchanging path 521 of the heat exchanger B is the same at 40° C., the following calculation results can be obtained.

Flow path resistance of 6 first heat exchanging paths 511: $5.140\times10^{-5}$ Pa·s/m$^3$ Flow path resistance of 6 second heat exchanging paths 521: $3.256\times10^{-5}$ Pa·s/m$^3$ Flow path resistance of 6 resistance paths 522: $2.086\times10^{-5}$ Pa·s/m$^3$ Sum of flow path resistances: $2.619\times10^{-5}$ Pa·s/m$^3$ Flow rate of the heat exchanger A: 1.529 mL/s Flow rate of the heat exchanger B: 1.471 mL/s Ratio of flow rate: 0.96

According to these calculation results, when the temperatures of the inks flowing in the first temperature-adjusting path 51 and the second temperature-adjusting path 52, respectively, in the ink temperature adjusting unit 5 are equal to each other, as in the calculation results in (1) described above, the flow rate of ink flowing in the second heat exchanging path 521 is smaller because there is a flow path resistance attributed to the resistance path 522. The flow rate of the ink flowing in the second heat exchanging path 521 is 0.96 times the flow rate of the ink flowing in the first heat exchanging path 511.

(4) Relationship Between the Flow Rate of Ink and the Flow Path Resistance when the Ink is Cooled When the ink temperature adjusting unit 5 is in the state shown in FIG. 5C as described, the temperature of the ink in the path in the ink circulation system 1 is 40° C. and the temperature of the ink circulating the first heat exchanging path 511 of the heat exchanger A of the ink temperature adjusting unit 5 is lowered by 5° C. to reach 35° C. by putting into operation the cooling unit 54 or the cooling unit 55 in combination with the cooling unit 54, the following calculation results can be obtained.

Sum of flow path resistances: $2.713\times10^{-5}$ Pa·s/m$^3$

Flow rate of the heat exchanger A: 1.476 mL/s

Flow rate of the heat exchanger B: 1.524 mL/s

Ratio of flow rate: 1.03

According to these calculation results, in the ink temperature adjusting unit 5, when operating the cooling unit 54 or the cooling unit 54 in combination with the cooling unit 55, thereby cooling the first temperature-adjusting path 51, the viscosity of the ink flowing in the second heat exchanging path 521 including the resistance path 522 increases, the flow path resistance increases, and therefore the flow rate of the ink flowing in the second heat exchanging path 521 decreases. Accordingly, the flow rate of the ink flowing in the first heat exchanging path 511 relatively increases. The flow rate of the ink flowing in the second heat exchanging path 521 drops to be 1.03 times the flow rate of the ink flowing in the first heat exchanging path 511.

FIGS. 9A and 9B shows the calculation results of temperature dependencies of the flow rate of ink circulating in the first heat exchanging path 511 and the second heat exchanging path 521 and the flow path resistance with different sizes of the first heat exchanging path 511 of the heat exchanger A and the resistance path 522 of the heat exchanger B in the ink temperature adjusting unit 5. Here, the length L of the first heat exchanging path 511 of the heat exchanger A (the first heat exchanging block 510) is set to 300 mm, the diameter ΦA thereof is set to 3 mm. The length L1 of the second heat exchanging path 521 of the heat exchanger B (the second heat exchanging block 520) is set to 190 mm, the diameter ΦB1 thereof is set to 4 mm. The length L2 of the resistance path 522 is set to 110 mm, and the diameter ΦB2 thereof is set to 2.4 mm. Items of the horizontal columns and vertical columns in FIGS. 9A and 9B are the same as the items of the horizontal columns and vertical columns in FIGS. 8A and 8B, respectively.

(5) Relationship Between the Flow Rate of Ink and the Flow Path Resistance when the Temperature of the Ink is the Same (at a Low Temperature)

When the ink temperature adjusting unit 5 is in the state shown in FIG. 5A as described, the temperature of the ink in the path of the ink circulation system 1 is 10° C., the temperature of the ink circulating in the first heat exchanging path 511 of the heat exchanger A of the ink temperature adjusting unit 5 is 10° C., and the temperature of the ink circulating in the second heat exchanging path 521 of the heat exchanger B is the same at 10° C., the following calculation results can be obtained.

Flow path resistance of 6 first heat exchanging paths 511: $4.530\times10^{-4}$ Pa·s/m$^3$ Flow path resistance of 6 second heat exchanging paths 521: $9.077\times10^{-5}$ Pa·s/m$^3$ Flow path resistance of 6 resistance paths 522: $4.055\times10^{-4}$ Pa·s/m$^3$ Sum of flow path resistances: $2.368\times10^{-4}$ Pa·s/m$^3$ Flow rate of the heat exchanger A: 1.568 mL/s Flow rate of the heat exchanger B: 1.432 mL/s Ratio of flow rate: 0.91

According to these calculation results, when the temperatures of the inks flowing in the first heat exchanging path 511 and the second heat exchanging path 521, respectively, in the ink temperature adjusting unit 5 are equal to each other, the flow rate of ink flowing in the second heat exchanging path 521 is smaller because there is a flow path resistance attributed to the resistance path 522. The flow rate of the ink flowing in the second heat exchanging path 521 is 0.91 times the flow rate of the ink flowing in the first heat exchanging path 511.

(6) Relationship Between the Flow Rate of Ink and the Flow Path Resistance when the Ink is Heated When the ink temperature adjusting unit 5 is in the state shown in FIG. 5B as described, the temperature of the ink in the path of the ink circulation system 1 is 10° C. and the temperature of the ink circulating in the second heat exchanging path 521 of the heat exchanger B of the ink temperature adjusting unit 5 is raised by 15° C. to reach 25° C. by putting the heating unit 56 into operation, the following calculation results can be obtained.

Sum of flow path resistances: $1.865\times10^{-4}$ Pa·s/m$^3$

Flow rate of the heat exchanger A: 1.235 mL/s

Flow rate of the heat exchanger B: 1.765 mL/s

Ratio of flow rate: 1.43

According to these calculation results, in the ink temperature adjusting unit 5, when the heating unit 56 is put into operation, and thereby the second temperature-adjusting path 52 is heated, the viscosity of the ink flowing in the second temperature-adjusting path 52 including the resistance path 522 decreases, the flow path resistance decreases, and therefore the flow rate of the ink flowing in the second heat exchanging path 521 increases. Accordingly, the flow rate of the ink flowing in the first heat exchanging path 511 relatively decreases. The flow rate of the ink flowing in the second heat exchanging path 521 reaches 1.43 times the flow rate of the ink flowing in the first heat exchanging path 511.

In the example shown in FIGS. 9A and 9B, the diameter ΦA of the first heat exchanging path 511 is set to be smaller than the diameter ΦB1 of the second heat exchanging path 521, and further the diameter ΦA of the first heat exchanging path 511 is set to be larger than the diameter ΦB2 of the resistance path 522. When the diameter ΦA of the first heat exchanging path 511 is set to be small, the flow rate of the ink flowing in the second heat exchanging path 521 increases.

(7) Relationship Between the Flow Rate of Ink and the Flow Path Resistance when the Temperature of the Ink is the Same (at a High Temperature)

When the ink temperature adjusting unit 5 is in the state shown in FIG. 5A as described, the temperature of the ink in the path of the ink circulation system 1 is 40° C., the temperature of the ink circulating in the first heat exchanging path 511 of the heat exchanger A of the ink temperature adjusting unit 5 is 40° C., and the temperature of the ink circulating in the second heat exchanging path 521 of the heat exchanger B is the same at 40° C., the following calculation results can be obtained.

Flow path resistance of 6 first heat exchanging paths 511: $1.625\times10^{-4}$ Pa·s/m$^3$ Flow path resistance of 6 second heat exchanging paths 521: $3.256\times10^{-5}$ Pa·s/m$^3$ Flow path resistance of 6 resistance paths 522: $1.454\times10^{-4}$ Pa·s/m$^3$ Sum of flow path resistances: $8.494\times10^{-5}$ Pa·s/m$^3$ Flow rate of the heat exchanger A: 1.568 mL/s Flow rate of the heat exchanger B: 1.432 mL/s Ratio of flow rate: 0.91

According to these calculation results, when the temperatures of the inks flowing in the first temperature-adjusting path 51 and the second temperature-adjusting path 52, respectively, in the ink temperature adjusting unit 5 are equal to each other, the flow rate of ink flowing in the second heat exchanging path 521 is reduced because there is a flow path resistance attributed to the resistance path 522. The flow rate of the ink flowing in the second heat exchanging path 521 is 0.91 times the flow rate of the ink flowing in the first heat exchanging path 511.

(8) Relationship Between the Flow Rate of Ink and the Flow Path Resistance when the Ink is Cooled When the ink temperature adjusting unit 5 is in the state shown in FIG. 5C as described, the temperature of the ink in the path in the ink circulation system 1 is 40° C. and the temperature of the ink circulating the first heat exchanging path 511 of the heat exchanger A of the ink temperature adjusting unit 5 is lowered by 5° C. to reach 35° C. by putting into operation the cooling unit 54 or the cooling unit 55 in combination with the cooling unit 54, the following calculation results can be obtained.

Sum of flow path resistances: $8.806\times10^{-5}$ Pa·s/m$^3$

Flow rate of the heat exchanger A: 1.516 mL/s

Flow rate of the heat exchanger B: 1.484 mL/s

Ratio of flow rate: 0.98

According to these calculation results, in the ink temperature adjusting unit 5, when operating the cooling unit 54 or the cooling unit 54 in combination with the cooling unit 55, thereby cooling the first temperature-adjusting path 51, the viscosity of the ink flowing in the second heat exchanging path 521 including the resistance path 522 increases, the flow path resistance increases, and therefore the flow rate of the ink flowing in the second heat exchanging path 521 decreases. Accordingly, the flow rate of the ink flowing in the first heat exchanging path 511 relatively increases. The flow rate of the ink flowing in the second heat exchanging path 521 drops to be 0.98 times the flow rate of the ink flowing in the first heat exchanging path 511.

Modification Examples of the Ink Temperature Adjusting Unit

Regarding the inkjet printer 10 according to the first embodiment described above, the resistance path 522 of the ink temperature adjusting unit 5 can be modified as shown in a first modification example to a twelfth modification example which will be described below.

Figure 10A:
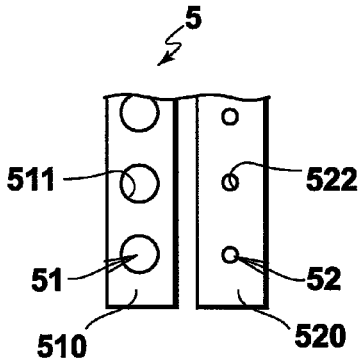
Figure 10B:
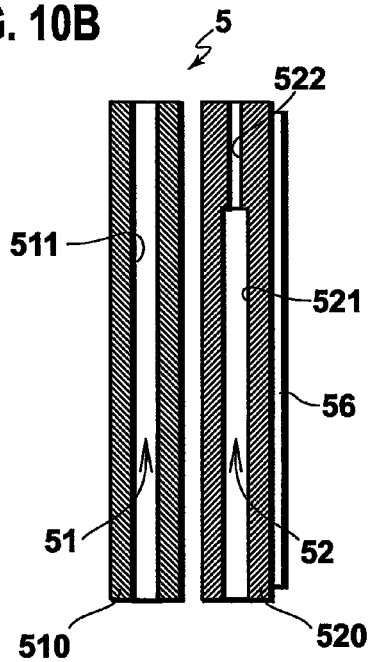
FIG. 10B is a cross-sectional view of a main portion which describes the same first modification example of the ink temperature adjusting unit.

As shown in FIG. 10A and FIG. 10B, in the ink temperature adjusting unit 5 according to a first modification example, as described above in the calculation model shown in FIG. 6A and FIG. 6B, the shapes of respective openings of the first heat exchanging path 511 of the heat exchanging block 510, the second heat exchanging path 521 of the second heat exchanging block 520, and the resistance path 522 are formed to be circular. The resistance path 522 is arranged on the first ink circulation path 32 side, that is, in the vicinity of the outlet of the second heat exchanging block 520. The diameter of the resistance path 522 is set to be smaller than the diameter of the second heat exchanging path 521 (and that of the first heat exchanging path 511). The resistance path 522 has a structure obtained by partially reducing the path diameter of the second heat exchanging path 521.

Figure 11A:
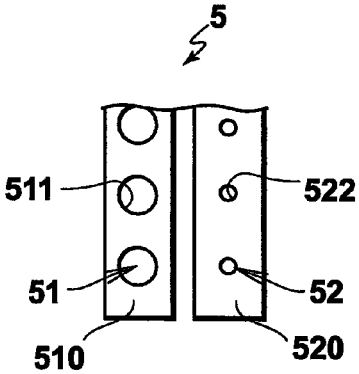
Figure 11B:
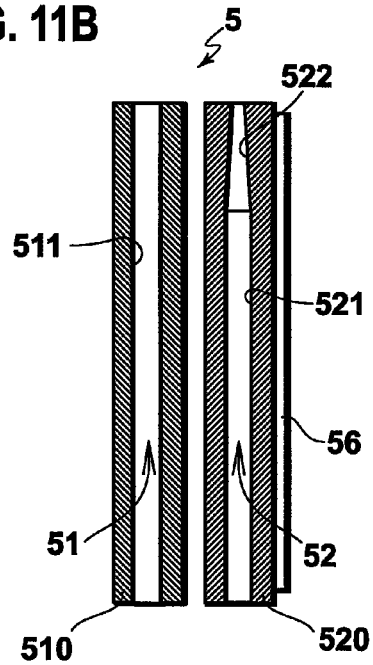
FIG. 11B is a cross-sectional view of a main portion which describes the same second modification example of the ink temperature adjusting unit.

In the ink temperature adjusting unit 5 according to a second modification example as shown in FIG. 11A and FIG. 11B, the basic configuration is the same as that of the ink temperature adjusting unit 5 according to the first modification example, but the pipe diameter of the resistance path 522 is gradually reduced toward the ink circulating direction, and therefore the shape of the cross section of the resistance path 522 is tapered. The diameter at a connecting portion between the resistance path 522 and the second heat exchanging path 521 is the same as the diameter of the second heat exchanging path 521. The diameter of the resistance path 522 on the first ink circulation path 32 side is smaller than the diameter of the connecting portion between the resistance path 522 and the second heat exchanging path 521.

Figure 12A:
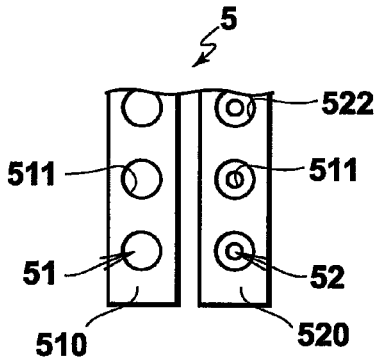
Figure 12B:
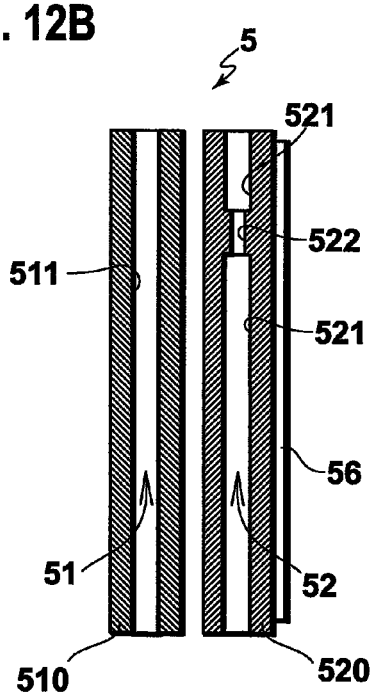
FIG. 12B is a cross-sectional view of a main portion for describing the same third modification example of the ink temperature adjusting unit.

In the ink temperature adjusting unit 5 according to a third modification example as shown in FIG. 12A and FIG. 12B, the resistance path 522 which has a diameter smaller than the diameter of the second heat exchanging path 521 is arranged at a middle of the second heat exchanging path 521 in the vicinity of the outlet side thereof.

Figure 13A:
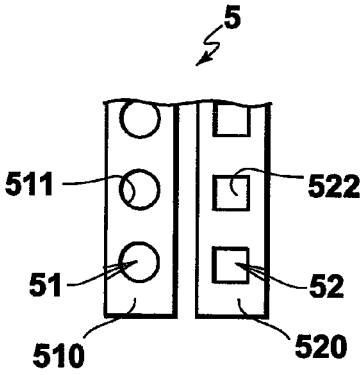
Figure 13B:
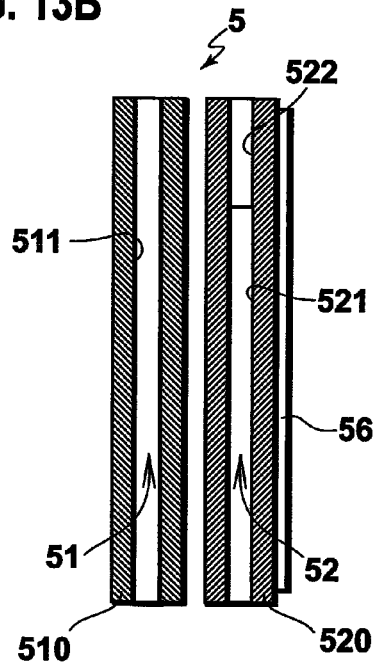
FIG. 13B is a cross-sectional view of a main portion for describing the same fourth modification example of the ink temperature adjusting unit.

In the ink temperature adjusting unit 5 according to a fourth modification example as shown in FIG. 13A and FIG. 13B, the basic configuration is the same as that of the ink temperature adjusting unit 5 according to the first modification example, but the opening of the resistance path 522 is formed into a square shape while the shapes of the openings of the first heat exchanging path 511 and the second heat exchanging path 521 are circular, so that the flow path resistance of the resistance path 522 is increased.

Figure 14A:
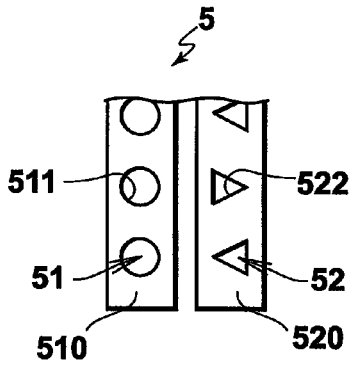
Figure 14B:
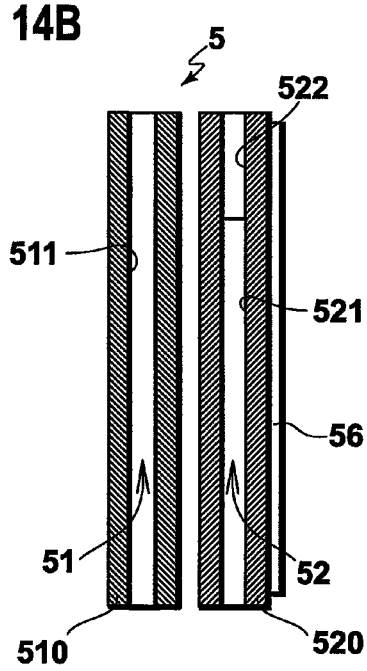
FIG. 14B is a cross-sectional view of a main portion for describing the same fifth modification example of the ink temperature adjusting unit.

The ink temperature adjusting unit 5 according to a fifth modification example, as shown in FIG. 14A and FIG. 14B, is a modification example obtained by further modifying the ink temperature adjusting unit 5 according to the fourth modification example, and has the resistance path 522 having a triangle-shaped opening, so that the flow path resistance thereof is increased.

Figure 15A:
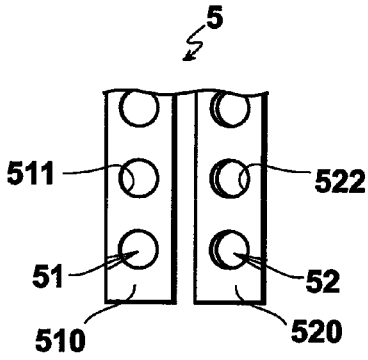
Figure 15B:
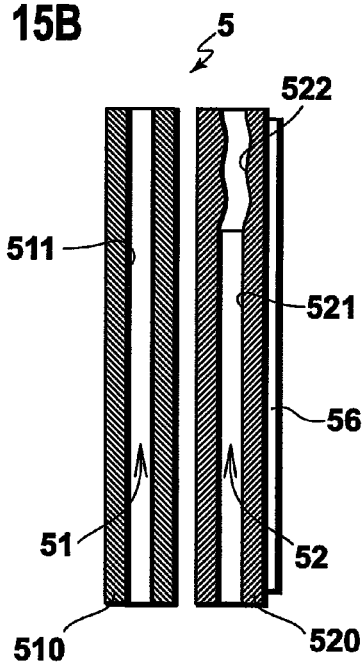
FIG. 15B is a cross-sectional view of a main portion for describing the same sixth modification example of the ink temperature adjusting unit.

In the ink temperature adjusting unit 5 according to a sixth modification example as shown in FIG. 15A and FIG. 15B, the resistance path 522 runs meandering in an ink circulation direction in the second heat exchanging block 520, so that the flow path resistance of the resistance path 522 is increased.

Figure 16A:
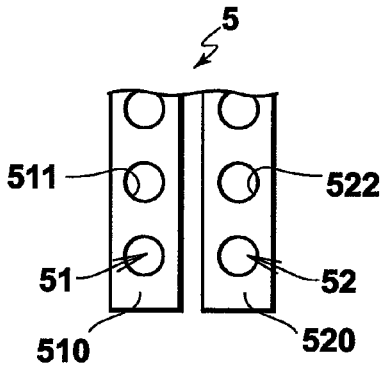
Figure 16B:
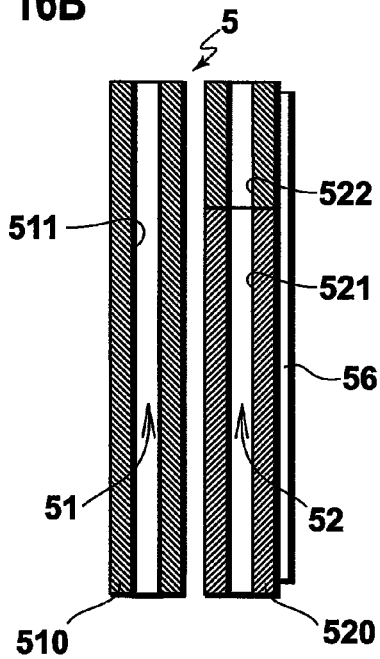
FIG. 16B is a cross-sectional view of a main portion for describing the same seventh modification example of the ink temperature adjusting unit.

In the ink temperature adjusting unit 5 according to a seventh modification example as shown in FIG. 16A and FIG. 16B, the material of the resistance path 522 of the second heat exchanging block 520 is changed to a material with which the flow path resistance is increased. In other words, in the resistance path 522, the roughness of a portion of the path inner wall is higher, so that the flow path resistance is increased. The diameter of the second heat exchanging path 521 and the diameter of the resistance path 522 may be set to be the same as long as the effective flow path resistance of the resistance path 522 is high.

Figure 17A:
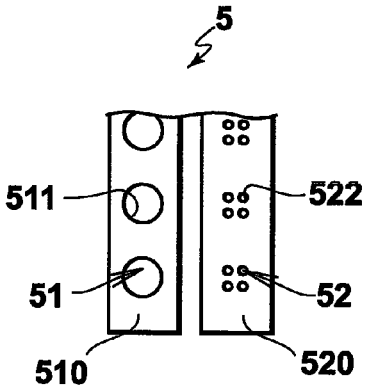
Figure 17B:
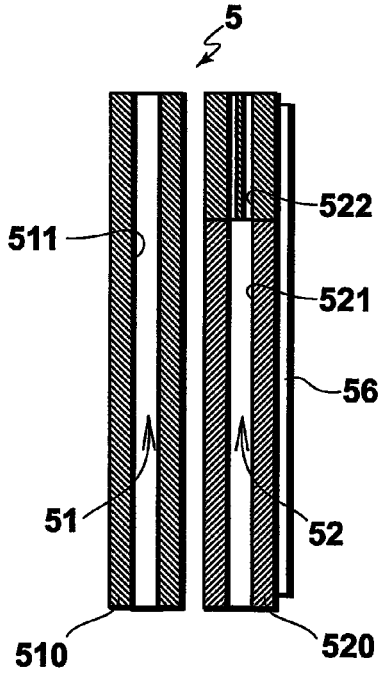
FIG. 17B is a cross-sectional view of a main portion for describing the same eighth modification example of the ink temperature adjusting unit.

In the ink temperature adjusting unit 5 according to an eighth modification example as shown in FIG. 17A and FIG. 17B, the resistance path 522 of the second heat exchanging block 520 is formed with multiple paths, which each have a smaller diameter than the diameter of the second heat exchanging path 521, arranged in parallel to each other. This resistance path 522 may be manufactured with a material, which can be easily processed, different from that of the second heat exchanging block 520, similarly to the ink temperature adjusting unit 5 according to the seventh modification example.

Figure 18A:
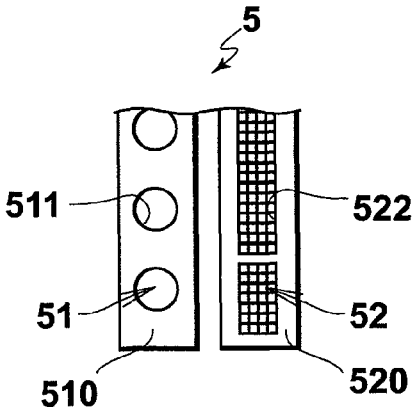
Figure 18B:
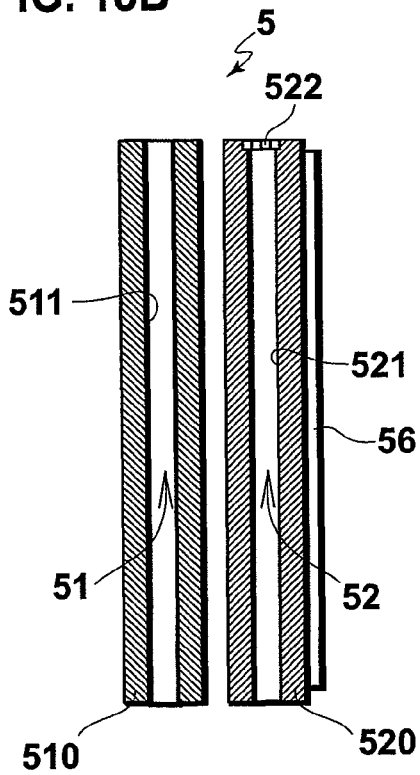
FIG. 18B is a cross-sectional view of a main portion for describing the same ninth modification example of the ink temperature adjusting unit.

In the ink temperature adjusting unit 5 according to a ninth modification example as shown in FIG. 18A and FIG. 18B, the resistance path 522 of the second heat exchanging block 520 is formed with a mesh material having multiple holes.

Figure 19:
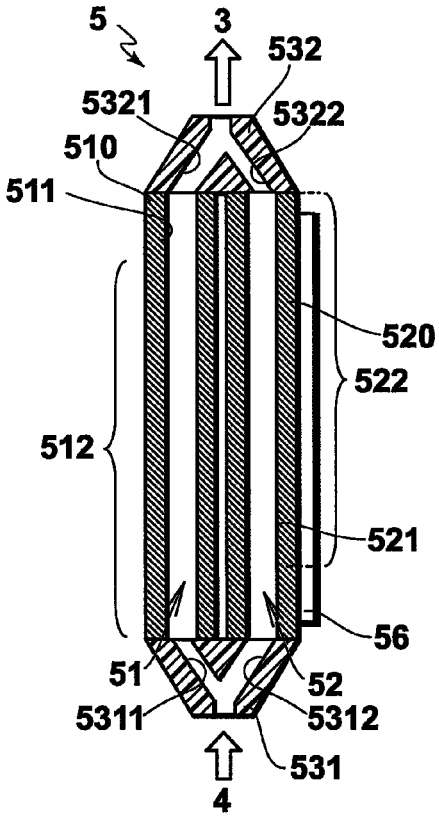
FIG. 19 is a cross-sectional view of a main portion for describing a tenth modification example of the ink temperature adjusting unit.

In the ink temperature adjusting unit 5 according to a tenth modification example as shown in FIG. 19, instead of the second heat exchanging block 520, the second confluence path 5322 of the confluence unit 532 has the function of the resistance path 522 described above. More specifically, the diameter of the confluence path 5322 of the confluence unit 532 is set to be smaller than the diameter of the second heat exchanging path 521. It should be noted that, although the diameter of the first branching path 5311, which is a portion of the branching unit 531 connected to the first heat exchanging path 511, is set to be small similarly to that of the second confluence path 5322, the first branching path 5311 does not function as the resistance path 522 according to the first embodiment. This is more for the advantage of being able to manufacture the branching unit 531 and the confluence unit 532 both having the same structure.

Figure 20:
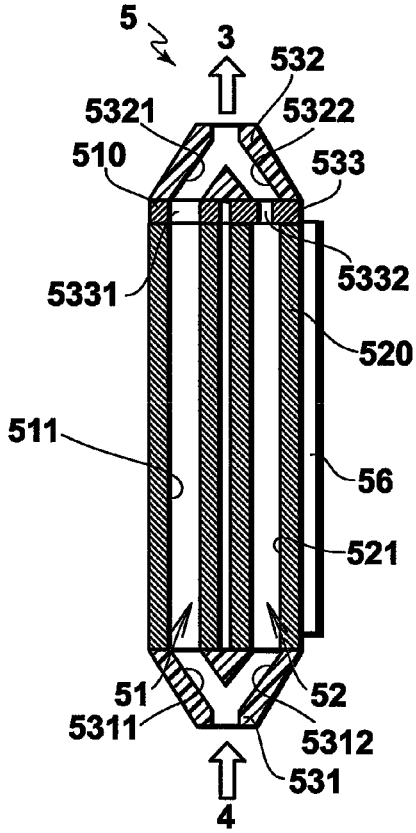
FIG. 20 is a cross-sectional view of a main portion for describing an eleventh modification example of the ink temperature adjusting unit.

In the ink temperature adjusting unit 5 according to an eleventh modification example as shown in FIG. 20, a block 533 including the resistance path 5332 having a similar function to that of the resistance path 522 described above is manufactured, and arranged between the second heat exchanging block 520 and the confluence unit 532. The resistance path 5332 of the block 533 is connected each to the second heat exchanging path 521 of the second heat exchanging block 520 and the second confluence path 5322 of the confluence unit 532. The diameter of the resistance path 5332 is smaller than the diameter of the second heat exchanging path 521. It should be noted that the block 533 is also arranged between the first heat exchanging block 510 and the confluence unit 532, and is provided with a path 5331 which connects the first heat exchanging path 511 of the first heat exchanging block 510 and the first confluence path 5321 of the confluence unit 532.

Figure 21:
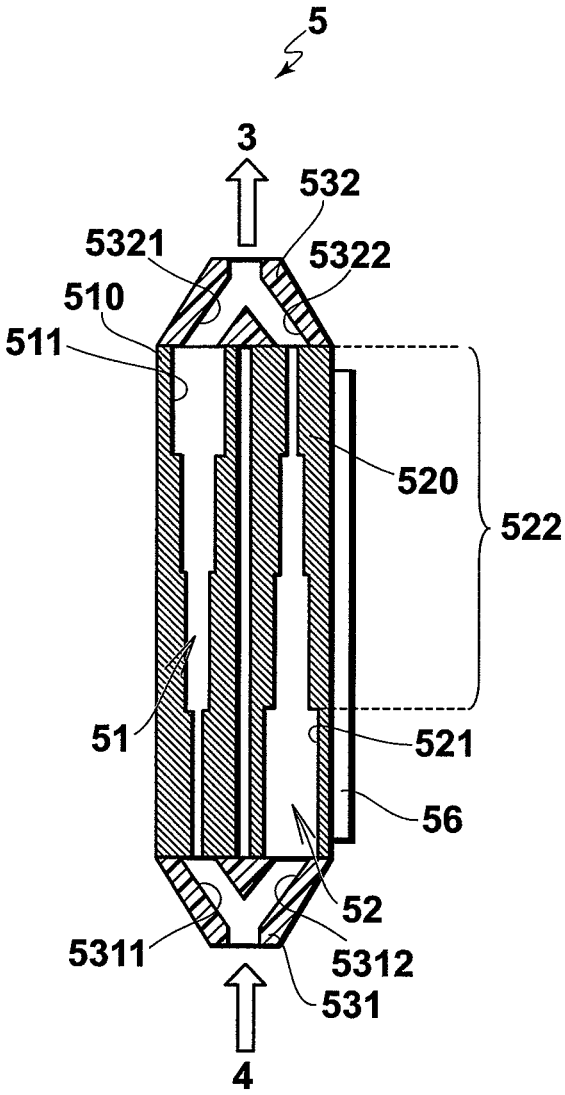
FIG. 21 is a cross-sectional view of a main portion for describing a twelfth modification example of the ink temperature adjusting unit.

In the ink temperature adjusting unit 5 according to a twelfth modification example as shown in FIG. 21, the path diameter of the second heat exchanging path 521 of the second heat exchanging block 520 is gradually reduced toward the ink circulating direction, and a region having a reduced path diameter functions as the resistance path 522. In the present example, the path diameter of the first heat exchanging path 511 of the first heat exchanging block 510 is gradually expanded toward the ink circulating direction. However, the first heat exchanging path 511 does not function as the resistance path 522 according to the first embodiment.

Features of the First Embodiment

As described above, the inkjet printer 10 according to the first embodiment includes: the first temperature-adjusting path 51 and the second temperature-adjusting path 52 through which circulation of ink from the second ink circulation path 42 branch off and come together at the first ink circulation path 32; the resistance path 522 in the second temperature-adjusting path 52; and the ink temperature adjusting unit 5 which allows self adjustment of the circulation flow rate of ink. In the ink temperature adjusting unit 5, the flow rate of the ink flowing in the second temperature-adjusting path 52 can be automatically increased when the circulating ink is to be heated, and the flow rate of the ink flowing in the first temperature-adjusting path 51 can be automatically increased when the ink is to be cooled. Accordingly, it is possible to improve the heating efficiency and cooling efficiency of the ink circulating in the ink circulation system 1 in a simple structure without using a solenoid valve together with a control system thereof.

Further, as having such a simple structure, the ink temperature adjusting unit 5 according to the first embodiment can be easily manufactured; therefore, the production cost thereof can be reduced. As a result, the inkjet printer 10 has a simpler structure, and therefore can be easily manufactured; thus, the production cost can be reduced.

Further, in the ink temperature adjusting unit 5 according to the first embodiment, the branching unit 531, which is configured to divide ink, and the confluence unit 532, which is configured to assemble (get together) ink, both having a slightly complicated inner path are provided as independent parts from the first heat exchanging block 510 and the second heat exchanging block 520 which are used for heat exchange. Accordingly, the production can be easily performed.

Second Embodiment

A second embodiment of the present invention describes an example in which the arrangement position of the heating unit 56 in the ink temperature adjusting unit 5 of the inkjet printer 10 according to the first embodiment described above is changed.

Figure 22:
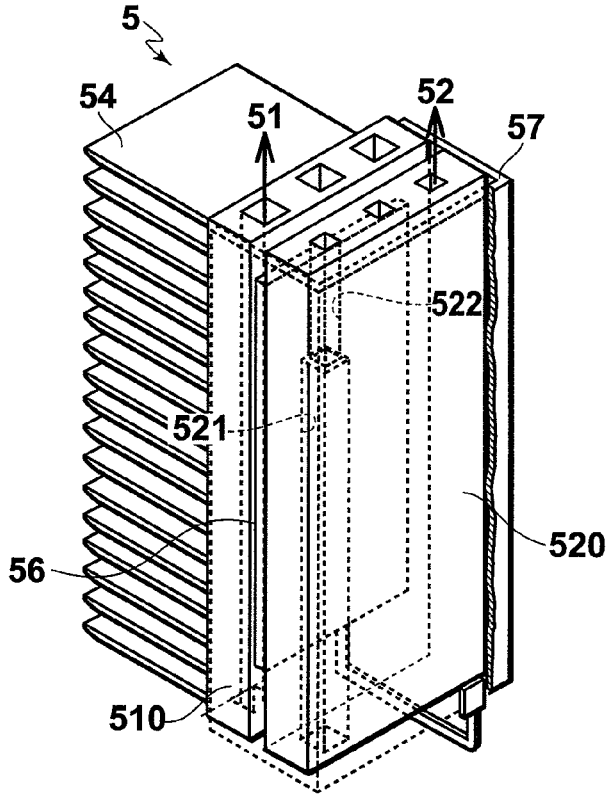
FIG. 22 is a perspective view of a main portion of an ink temperature adjusting unit of an inkjet printer according to a second embodiment.
Figure 23:
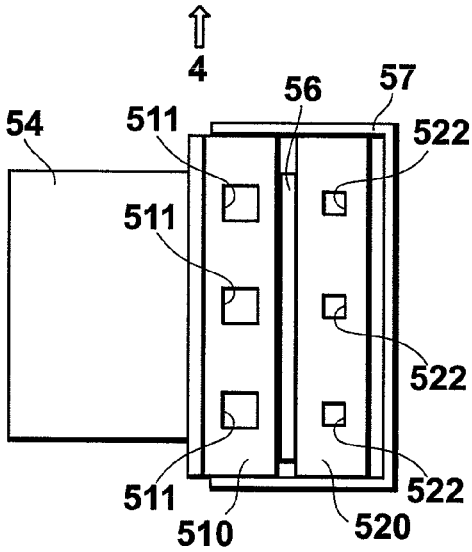
FIG. 23 is a top view of a main portion of the ink temperature adjusting unit shown in FIG. 22.

In the ink temperature adjusting unit 5 according to the second embodiment as shown in FIG. 22 and FIG. 23, the basic structure is the same as that of the ink temperature adjusting unit 5 according to the first embodiment described above; however, the second heat exchanging block 520 is provided side by side with the first heat exchanging block 510 with a prescribed distance therebetween, and the heating unit 56 is attached to the second heat exchanging block 520 between the first heat exchanging block 510 and the second heat exchanging block 520. The configuration of the heating unit 56 is the same as the configuration of the heating unit 56 according to the first embodiment described above.

The ink temperature adjusting unit 5, having such a configuration, of the inkjet printer 10 according to the second embodiment has the heating unit 56 arranged between the first heat exchanging block 510 and the second heat exchanging block 520. With the heating unit 56 thus arranged, the heat transfer path between the first heat exchanging block 510 and the second heat exchanging block 520 is blocked, so that heat of the ink flowing in the second heat exchanging path 521 of the second heat exchanging block is prevented from flowing toward the first heat exchanging block 510. Moreover, the second heat exchanging path 521 is heated from the first heat exchanging block 510 side, so that the heating efficiency of the ink flowing in the second heat exchanging path 521 can be improved.

Third Embodiment

A third embodiment of the present invention describes an example in which the ink temperature adjusting unit 5 of the inkjet printer 10 according to the first embodiment and the ink temperature adjusting unit 5 of the inkjet printer 10 according to the second embodiment described above are combined.

Figure 24:
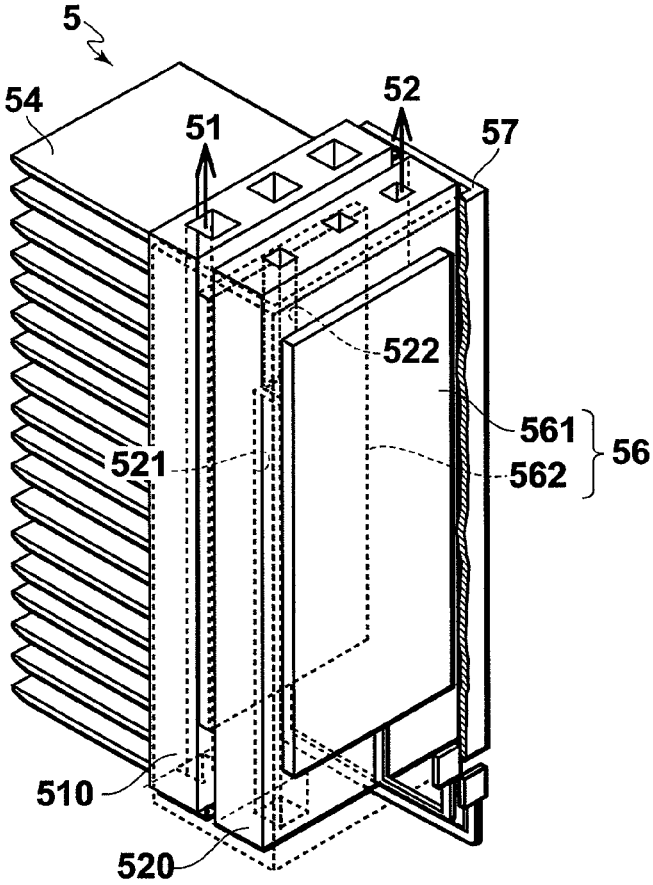
FIG. 24 is a perspective view of a main portion of an ink temperature adjusting unit of an inkjet printer according to a third embodiment.
Figure 25:
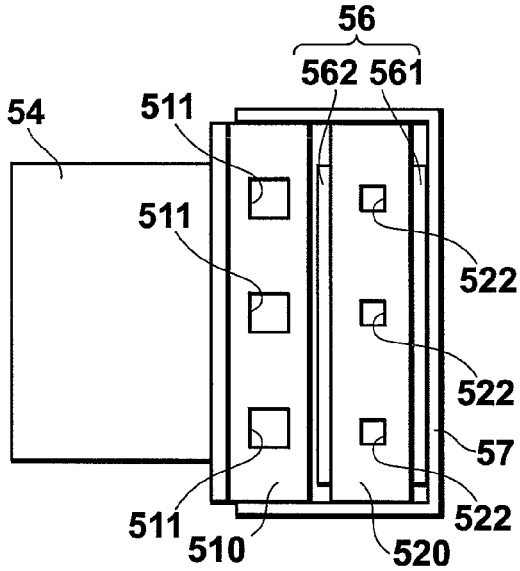
FIG. 25 is a top view of a main portion of the ink temperature adjusting unit shown in FIG. 24.

The ink temperature adjusting unit 5 according to the third embodiment as shown in FIG. 24 and FIG. 25 has the heating unit 56 including a first heating unit 561 which is arranged at a position equivalent to that of the heating unit 56 of the ink temperature adjusting unit 5 according to the first embodiment, and a second heating unit 562 which is arranged at a position equivalent to that of the heating unit 56 of the ink temperature adjusting unit 5 according to the second embodiment.

In the ink temperature adjusting unit 5, having such a configuration, of the inkjet printer 10 according to the third embodiment, an effect obtained by combining the effect obtained with the ink temperature adjusting unit 5 according to the first embodiment and the effect obtained with the ink temperature adjusting unit 5 according to the second embodiment can be obtained.

Other Embodiments

As described above, the present invention has been described by using the first to third embodiments. However, the description and drawings which constitute part of this disclosure do not limit the present invention. The present invention can be applied to various alternative embodiments, examples and operation techniques. For example, the ink temperature adjusting unit 5 according to the examples above has the first temperature-adjusting path 51 which is configured to cool circulating ink and the second temperature-adjusting path 52 which is configured to heat the ink. However, the present invention may further include a third temperature-adjusting path which is configured to achieve a temperature between those achieved by the cooling and heating described in the above examples, or more temperature-adjusting paths.

In addition, the ink temperature adjusting unit 5 according to the examples described above has two cooling units 54 and 55; however, the present invention only needs to include one of the cooling units 54 and 55.

Moreover, as described in the beginning, the present invention is not limited to a color inkjet printer, and also applicable to a monochrome inkjet printer. In addition, the present invention can be applied to a multifunctional inkjet printer which has a scanner function and/or a facsimile function.

What is claimed is:

1. An inkjet printer comprising:

an inkjet print head;

a first ink circulation path connected to the print head and configured to supply ink to the print head;

a second ink circulation path connected to the print head and configured to circulate ink discharged from the print head; and an ink temperature adjusting unit, wherein the ink temperature adjusting unit includes a first temperature-adjusting path connected to the first ink circulation path and the second ink circulation path for use in cooling ink discharged from the print head, and a second temperature-adjusting path connected to the second ink circulation path separately from the first temperature-adjusting path and connected to the first ink circulation path while joining the first temperature-adjusting path for use in heating ink discharged from the print head, the second temperature-adjusting path having a larger flow path resistance than a flow path resistance of the first temperature-adjusting path at least on a side thereof near the first ink circulation path.

2. The inkjet printer according to claim 1, wherein the ink flows both in the first temperature-adjusting path and the second temperature-adjusting path at the same time during circulation of ink.

3. The inkjet printer according to claim 1, wherein a flow path resistance of the second temperature-adjusting path is higher than the flow path resistance of the first temperature-adjusting path for inks respectively flowing in the first temperature-adjusting path and the second temperature-adjusting path having temperatures equal to each other, and a flow rate of ink flowing in the second temperature-adjusting path is larger than a flow rate of ink flowing in the first temperature-adjusting path when a temperature of ink flowing in the second temperature-adjusting path is higher by a prescribed number of degrees than a temperature of ink flowing in the first temperature-adjusting path.

4. The inkjet printer according to claim 1, wherein the second temperature-adjusting path has a portion having a higher flow path resistance than a flow path resistance of the other portion thereof due to at least one of a partial reduction in a path diameter thereof, a partial expansion in a path length thereof, and a partial increase in roughness of a path inner wall thereof.

5. The inkjet printer according to claim 1, wherein the ink temperature adjusting unit includes:

a first heat exchanging block having a first heat exchanging path extending from a first surface of the first heat exchanging block on a side of the first ink circulation path to a second surface of the first heat exchanging block on a side of the second ink circulation path;

a second heat exchanging block having a second heat exchanging path extending from a third surface of the second heat exchanging block on a side of the first ink circulation path to a fourth surface of the second heat exchanging block on a side of the second circulation path;

a confluence unit provided on the first surface of the first heat exchanging block and the third surface of the second heat exchanging block and having a first confluence path connecting the first heat exchanging path and the first ink circulation path and a second confluence path connecting the second heat exchanging path and the first ink circulation path; and a branching unit provided on the second surface of the first heat exchanging block and the fourth surface of the second heat exchanging block and having a first branching path connecting the first heat exchanging path and the second ink circulation path and a second branching path connecting the second heat exchanging path and the second ink circulation path, the first temperature-adjusting path is formed by a connection of the first branching path of the branching unit, the first heat exchanging path of the first heat exchanging block, and the first confluence path of the confluence unit, and the second temperature-adjusting path is formed by a connection of the second branching path of the branching unit, the second heat exchanging path of the second heat exchanging block, and the second confluence path of the confluence unit.

6. The inkjet printer according to claim 5, further comprising:

a heating unit provided along the second temperature-adjusting path and configured to heat ink flowing in the second temperature-adjusting path; and a cooling unit provided along the first temperature-adjusting path and configured to cool ink flowing in the first temperature-adjusting path, wherein the second heat exchanging block is apart from the first heat exchanging block, and the heating unit is attached to the second heat exchanging block between the first heat exchanging block and the second heat exchanging block.

7. The inkjet printer according to claim 1, further comprising:

a heating unit provided along the second temperature-adjusting path and configured to heat ink flowing in the second temperature-adjusting path; and a cooling unit provided along the first temperature-adjusting path and configured to cool ink flowing in the first temperature-adjusting path.

8. The inkjet printer according to claim 7, wherein the cooling unit is a heat sink.

9. The inkjet printer according to claim 1, further comprising:

a first ink tank connected to the first ink circulation path and configured to store ink to be supplied to the print head through the first ink circulation path; and a second ink tank connected to the second ink circulation path and configured to store ink discharged from the print head through the second ink circulation path, wherein the ink temperature adjusting unit is disposed between the first ink tank and the second ink tank, and the first temperature-adjusting path and the second temperature-adjusting path are connected to the first ink circulation path through the first ink tank and connected to the second ink circulation path through the second ink tank.

* * * * *